US010583956B2

(12) United States Patent
Hermosillo

(10) Patent No.: US 10,583,956 B2
(45) Date of Patent: Mar. 10, 2020

(54) WRAPAROUND DISPLAY WITH OVERLAPPING SECTIONS

(71) Applicant: INTERNATIONAL PAPER COMPANY, Memphis, TN (US)

(72) Inventor: Ignacio Padilla Hermosillo, San Jose Iturbide (MX)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 23 days.

(21) Appl. No.: 16/032,120

(22) Filed: Jul. 11, 2018

(65) Prior Publication Data

US 2020/0017256 A1 Jan. 16, 2020

(51) Int. Cl.
*B65D 5/54* (2006.01)
*B65D 5/52* (2006.01)

(52) U.S. Cl.
CPC ..... *B65D 5/5445* (2013.01); *B65D 5/5226* (2013.01); *B65D 5/542* (2013.01)

(58) Field of Classification Search
CPC .... B65D 5/5445; B65D 5/5226; B65D 5/542; B65D 2571/00574; B65D 5/54; B65D 5/546
USPC ..... 229/235, 240, 242; 206/736
See application file for complete search history.

(56) References Cited

U.S. PATENT DOCUMENTS 1,916,045 A * 6/1933 Freymann ..... B65D 5/52 206/750
2,723,026 A 11/1955 Paige
3,669,251 A 6/1972 Phillips, Jr.
3,786,914 A 1/1974 Beutler
3,884,348 A 5/1975 Ross
3,917,158 A * 11/1975 Dorofachuk ..... B65D 5/0227 229/241
3,942,631 A 3/1976 Sutherland et al.
4,000,811 A 1/1977 Hardison et al.
4,113,100 A 9/1978 Soja et al.
4,197,939 A 4/1980 Dogliotti
4,553,666 A * 11/1985 Gullikson ..... B65D 5/5445 229/112
5,167,324 A 12/1992 Miller
5,320,277 A * 6/1994 Stout ..... B65D 5/443 229/117.13
5,582,345 A 12/1996 Lankhuijzen
5,664,683 A 9/1997 Brody
5,690,213 A 11/1997 Matsumura
(Continued)

*Primary Examiner* — Christopher R Demeree
(74) *Attorney, Agent, or Firm* — Michael D. Folkerts; Thomas W. Ryan

(57) ABSTRACT

A shipping container convertible to a display case and formed from a one-piece blank of sheet material. The container comprises an upper front panel, first, second, and third main panels, and a lower front panel connected in series at respective fold lines. Upper front side flaps foldably joined to the upper front panel comprise a respective one of a first removable section and a second removable section each defined between respective pairs of separation lines. The first removable section extends across only a portion of a first end of the container, and the second removable section extends across only a portion of the second end. A lid portion of the shipping container is completely detachable from a base portion of the shipping container by removing the first and second removable sections and separating the lid and base portions along a separation line.

17 Claims, 14 Drawing Sheets

(56) References Cited

U.S. PATENT DOCUMENTS

| | | | | |
|---|---|---|---|---|
| 6,073,833 | A | 6/2000 | Desrosiers et al. | |
| 6,135,289 | A | 10/2000 | Miller | |
| 6,273,330 | B1 * | 8/2001 | Oliff | B65D 71/30 229/117.12 |
| 6,431,363 | B1 | 8/2002 | Hacker | |
| 6,435,351 | B1 | 8/2002 | Gibb | |
| 6,478,159 | B1 | 11/2002 | Taylor et al. | |
| 6,942,102 | B2 | 9/2005 | Justice | |
| 7,004,897 | B2 | 2/2006 | Spivey, Sr. | |
| 7,451,878 | B2 | 11/2008 | Rochefort et al. | |
| 7,549,542 | B2 | 6/2009 | Gasior et al. | |
| 7,703,666 | B2 | 4/2010 | Hand et al. | |
| 7,870,994 | B2 | 1/2011 | Spivey, Sr. et al. | |
| 8,342,335 | B2 | 1/2013 | Couture | |
| 8,430,297 | B2 | 4/2013 | Gatrost et al. | |
| 8,590,773 | B2 | 11/2013 | Moreau et al. | |
| 8,740,054 | B2 | 6/2014 | Pinkstone | |
| 8,840,011 | B2 | 9/2014 | Kohler | |
| 8,844,728 | B2 | 9/2014 | James et al. | |
| 8,910,856 | B2 | 12/2014 | Sumpmann et al. | |
| 8,939,290 | B2 | 1/2015 | DeCello et al. | |
| 9,073,682 | B2 | 7/2015 | DeBusk et al. | |
| 9,113,648 | B2 | 8/2015 | Burke | |
| 9,382,041 | B2 | 7/2016 | Couture | |
| 9,440,764 | B2 | 9/2016 | DeCello et al. | |
| 9,475,606 | B2 | 10/2016 | Ball et al. | |
| 9,938,040 | B2 | 4/2018 | Buscema | |
| 2019/0185201 | A1 * | 6/2019 | McCarthy | B65D 5/5445 |

* cited by examiner

WRAPAROUND DISPLAY WITH OVERLAPPING SECTIONS

FIELD OF THE INVENTION

This invention relates generally to containers for shipping products to points of sale. More particularly, the invention is a shipping container that is convertible to a display container at the point of sale.

BACKGROUND OF THE INVENTION

It is common practice to load a quantity of individual packages of consumer products into corrugated paperboard shipping containers for bulk shipment of the packages to a point of sale. At the point of sale, the individual packages may be removed from the shipping container and placed on a shelf for display and sale to the consumer.

In some instances, the product packages may be left in the shipping container, which then also serves to support and display the packages for sale. If the shipping container is a conventional box, then a retailer typically must cut away a portion of the box in order to expose the product packages and allow consumers to access them. To provide a more attractive display and facilitate ease of use by the retailer, combination shipping and display containers have been developed that have one or more sections that may be removed along weakened lines to expose the product packages and provide access to them.

SUMMARY OF THE INVENTION

In accordance with an aspect of the invention, a shipping container convertible to a display case and formed from a one-piece blank of sheet material is provided. The shipping container comprises an upper front panel, a first main panel, a second main panel, a third main panel, and a lower front panel connected in series at respective first, second, third, and fourth fold lines. A lid portion of the shipping container comprises the upper front panel and at least a portion of the first main panel, and a base portion of the shipping container comprises the lower front panel and the second and third main panels. The lid portion is connected to the base portion along a separation line. Upper front side flaps are foldably joined to the upper front panel. The upper front side flaps comprise a respective one of a first removable section and a second removable section each defined between respective pairs of separation lines. First, second, and third side flaps are foldably joined to respective ones of the first, second, and third main panels, and lower front side flaps are foldably joined to the lower front panel. The upper front and lower front side flaps overlap at least a portion of one or more of the first, second, and third side flaps to form first and second ends of the shipping container. The first removable section extends across only a portion of the first end, and the second removable section extends across only a portion of the second end. The lid portion of the shipping container is completely detachable from the base portion by removing the first and second removable sections and separating the lid and base portions along the separation line.

A first outer edge of the upper front panel may be adjacent to a second outer edge of the lower front panel without overlap, in which the upper and lower panels form a first side of the shipping container.

The first, second, and third main panels may form respective ones of the second, third, and fourth sides of the shipping container, and at least a portion of each of the first and second removable sections may taper in a direction extending from the third side toward the first side.

The first removable section may terminate at a junction of the first side and the first end of the shipping container, and the second removable section may terminate at a junction of the first side and the second end of the shipping container.

The upper front side flaps may comprise a respective one of a first curved projection and a second curved projection, and the lower front side flaps may comprise a respective one of a first recess and a second recess, in which the first recess corresponds to and receives the first curved projection without overlap and the second recess corresponds to and receives the second curved projection without overlap.

The upper front panel may comprise an outwardly curved outer edge, and the lower front panel may comprise an inwardly curved outer edge, in which the inwardly curved outer edge corresponds to and receives the outwardly curved outer edge without overlap.

The upper front side flaps may comprise a respective one of a first longitudinally outer section and a second longitudinally outer section, in which the first longitudinally outer section may be defined by a longitudinally outer one of the separation lines defining the first removable section and the second longitudinally outer section may be defined by a longitudinally outer one of the separation lines defining the second removable section.

The first and second longitudinally outer sections may remain adhered to the base portion following removal of the first and second removable sections.

The upper front side flaps may overlap a portion of at least one of the second side flaps or the third side flaps, in which the upper front side flaps may be adhered to the at least one of the second or third side flaps only at a joint formed between the first and second longitudinally outer sections and the at least one of the second or third side flaps.

The shipping container may be loaded and transported in a first orientation and used to display a product in a second, different orientation.

The first and second removable sections may each comprise a respective cutout, and the first side flaps may each comprise a respective cutout.

In accordance with another aspect of the invention, a one-piece blank of sheet material for forming a shipping container convertible to a display case is provided. The blank comprises an upper front panel and a plurality of main panels connected in series at respective fold lines. The upper front side flaps are foldably joined to laterally opposed ends of the upper front panel and comprise a respective one of a first removable section and a second removable section each defined between respective pairs of separation lines. The first removable section extends between a first lateral edge and a first longitudinal end of the blank, and the second removable section extends between a second lateral edge and the first longitudinal end of the blank.

At least a portion of the first removable section may taper in a direction away from the first lateral edge, and at least a portion of the second removable section may taper in a direction away from the second lateral edge.

The first removable section may taper substantially continuously in a direction away from the first lateral edge, and the second removable section may taper substantially continuously in a direction away from the second lateral edge.

The first removable section may comprise a cutout extending inward from the first lateral edge, and the second removable section may comprise a cutout extending inward from the second lateral edge.

The upper front side flaps may comprise a respective one of a first longitudinally outer section and a second longitudinally outer section, in which the first longitudinally outer section may be defined by a longitudinally outer one of the separation lines defining the first removable section and the second longitudinally outer section may be defined by a longitudinally outer one of the separation lines defining the second removable section.

The first longitudinally outer section may comprise a first curved projection extending outward in a longitudinal direction from a first longitudinal end of the blank, and the second longitudinally outer section may comprise a second curved projection extending outward in the longitudinal direction from the first longitudinal end of the blank.

The blank may further comprise a lower front panel and lower front side flaps foldably joined to laterally opposed ends of the lower front panel, in which the lower front side flaps may comprise a respective one of a first recess and a second recess extending inward in the longitudinal direction from a second longitudinal end of the blank, the first recess being configured to receive the first curved projection and the second recess being configured to receive the second curved projection.

The upper front panel may comprise an outwardly curved outer edge, and the lower front panel may comprise an inwardly curved outer edge, the inwardly curved outer edge corresponding to and being configured to receive the outwardly curved outer edge.

The blank may further comprise a lower front panel, the plurality of main panels may comprise a first main panel, a second main panel, a third main panel, and a lower front panel connected in series at respective first, second, third, and fourth fold lines, in which a first section of the blank may comprise the upper front panel and at least a portion of the first main panel and a second section of the blank may comprise the lower front panel and the second and third main panels, the first section being separable from the second section along a separation line.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction comprising a one-piece wraparound blank that is at least partially folded around a product to form a shipping container having a lid portion and a base portion, in which the shipping container comprises removable elements that may be removed to convert the shipping container to a display container for the product. The described container may be formed from a blank processed either with conventional equipment designed for this purpose or by hand. For example, the blank may be filled, folded, and/or closed using currently available case forming equipment to form the shipping container enclosing the product for shipping the product to a point of sale, or the container can be formed around the product through manually executed steps, or through a combination of machine implemented and manual steps.

Figure 1:
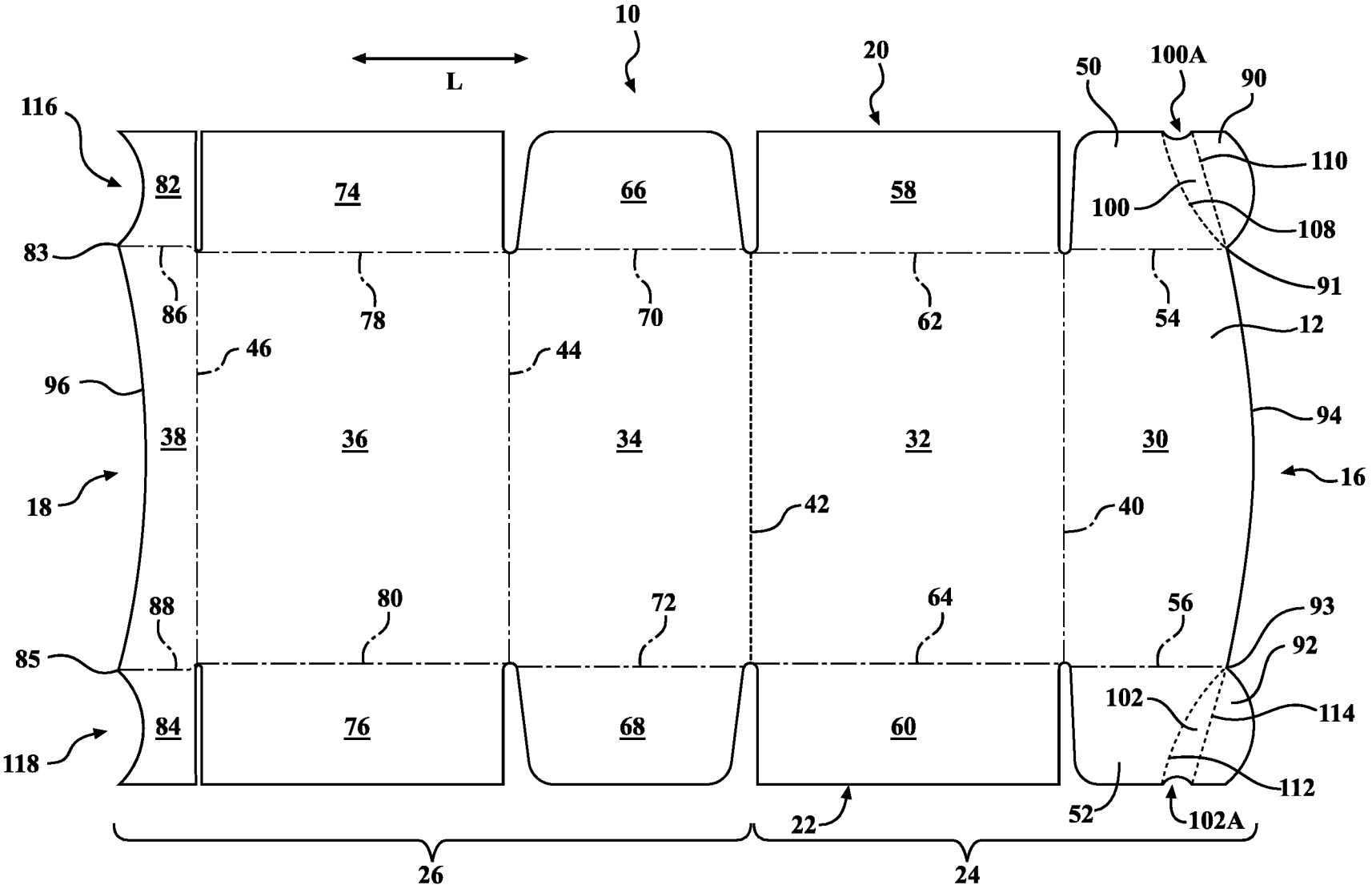
FIG. 1 is a plan view of a blank for forming a shipping container.
Figure 5A:
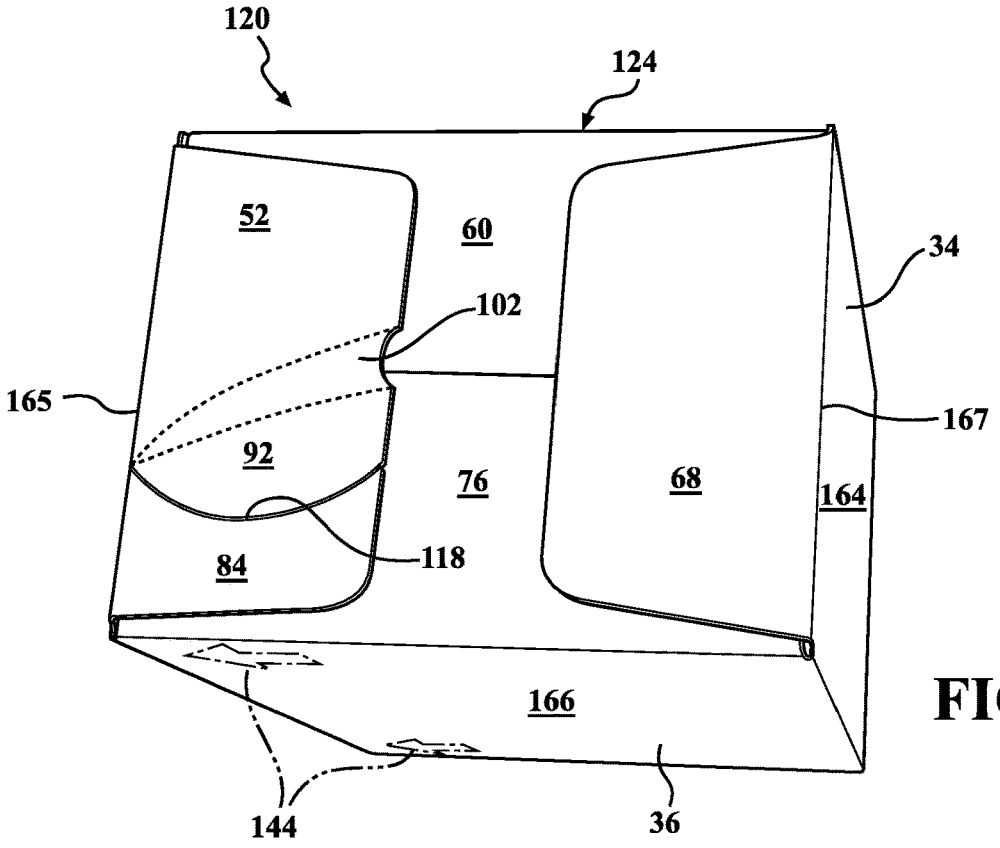
FIGS. 5A and 5B are perspective views illustrating a completed shipping container.
Figure 5B:
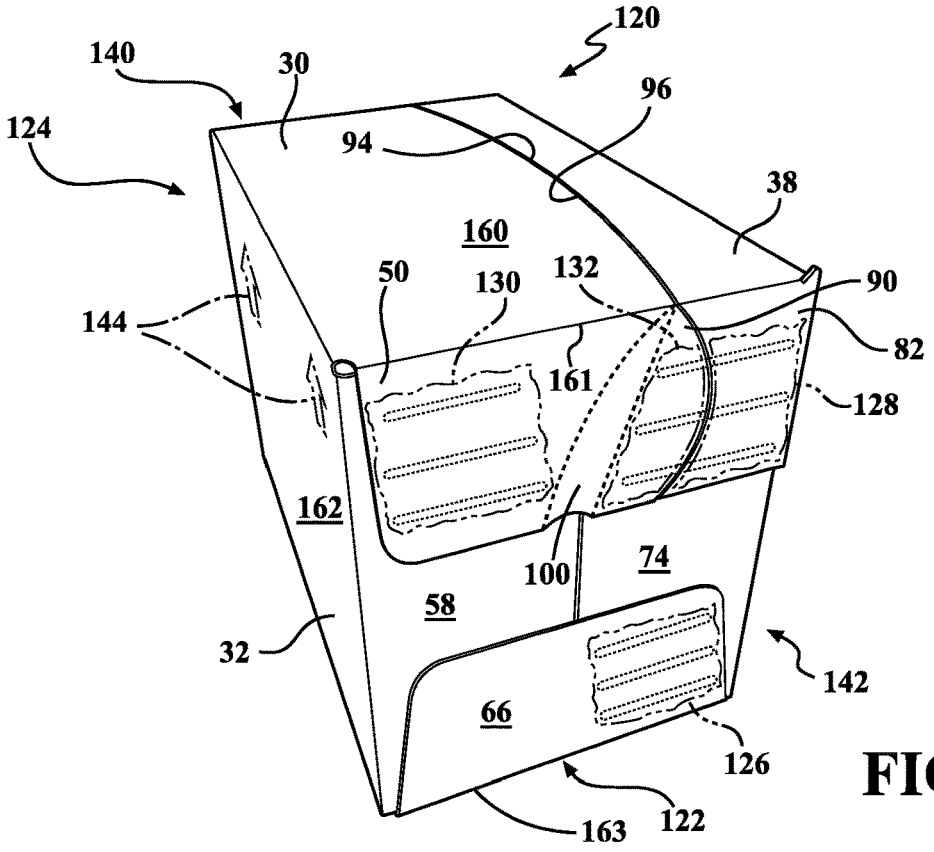

With reference to FIG. 1, a one-piece blank 10 is shown for illustrating one or more aspects of a container 120 described herein (see FIGS. 5A and 5B). The blank 10 may be formed of a corrugated cardboard material and may be die cut to the shape shown herein, although other materials and variations of the illustrated shape may be provided within the scope of the containers described and claimed herein. The blank 10 illustrated in FIG. 1 is a planar piece of material in which an inner surface 12 is shown facing out of the page and an outer surface 14 (see FIG. 2) is facing an opposite direction from the inner surface 12. The blank 10 extends in a longitudinal direction L between first and second longitudinal ends, generally designated 16 and 18, respectively, and further extends in a lateral direction between first and second lateral edges, generally designated 20 and 22, respectively.

The blank 10 comprises a plurality of panels connected in series at respective fold lines. The blank 10 may comprise an upper front panel 30, a first main panel 32, a second main panel 34, a third main panel 36, and a lower front panel 38. The blank 10 may include a first section 24 and a second section 26, in which the first section 24 comprises the upper front and first main panels 30, 32, and the second section 26 comprises the second and third main panels 34, 36 and the lower front panel 38. A longitudinal length of the first main panel 32, extending in the longitudinal direction L, may be substantially equal to a longitudinal length of the third main panel 36. A longitudinal length of the second main panel 34 may be substantially equal to a combined longitudinal length of the upper and lower front panels 30, 38. A longitudinal length of the lower front panel 38 may be less than a longitudinal length of the upper front panel 30. In some examples, the longitudinal length of the lower front panel 38 may be ≤50% of the longitudinal length of the upper front panel 30. In other examples, the longitudinal length of the lower front panel 38 may be less than the longitudinal length of any of the other individual panels 30, 32, 34, 36.

With continued reference to FIG. 1, the panels 30, 32, 34, 36, 38 of the blank 10 are connected in series, in which fold lines are represented by a dash-dot line and separation or tear lines are represented by a dashed line. The upper front panel 30 is connected to the first main panel 32 at a lateral fold line 40 (also referred to herein as a first fold line), the first main panel 32 is connected to the second main panel 34 at a lateral fold line 42 (also referred to herein as a second fold line), the second main panel 34 is connected to the third main panel 36 at a lateral fold line 44 (also referred to herein as a third fold line), and the lower front panel 38 is connected to the third main panel 36 at a lateral fold line 46 (also referred to herein as a fourth fold line). The second fold line 42 between the first and second main panels 32, 34 also comprises a separation line that may be defined, for example, by a partial cut through at least one layer of the corrugated material or a cut line interrupted by short sections of bridging (uncut) material. As will be further understood from the description below, the separation line defined at the second fold line 42 forms a structurally weakened line that may permit separation of the first main panel 32 from the second main panel 34, such that the first section 24 of the blank 10 is separable from the second section 26 along the second fold line 42.

The upper front panel 30 comprises upper front side flaps 50, 52 that are foldably joined to laterally opposed ends of the upper front panel 30 along respective longitudinal fold lines 54, 56. The first main panel 32 comprises first side flaps 58, 60 that are foldably joined to laterally opposed ends of the first main panel 32 along respective longitudinal fold lines 62, 64. The second main panel 34 comprises second side flaps 66, 68 that are foldably joined to laterally opposed ends of the second main panel 34 along respective longitudinal fold lines 70, 72. The third main panel 36 comprises third side flaps 74, 76 that are foldably joined to laterally opposed ends of the third main panel 36 along respective longitudinal fold lines 78, 80. The lower front panel 38 comprises lower front side flaps 82, 84 that are foldably joined to laterally opposed ends of the lower front panel 38 along respective longitudinal fold lines 86, 88.

The upper front side flap 50 of the upper front panel 30 may comprise a first longitudinally outer section 90 in the form of a curved projection (also referred to herein as a first curved projection) extending outwardly in the longitudinal direction L from the first longitudinal end 16 of the blank 10. The upper front side flap 52 may comprise a corresponding second longitudinally outer section 92 in the form of a curved projection (also referred to herein as a second curved projection) extending outwardly in the longitudinal direction L from the first longitudinal end 16 of the blank 10. The first longitudinal end 16 of the blank 10 may be formed by a first outer edge 94 of the upper front panel 30 and longitudinally outer edges (not separately labeled) of the longitudinally outer sections 90, 92.

The upper front side flap 50 may further comprise a first removable section 100 that is defined between two longitudinally spaced separation lines 108, 110 that extend substantially laterally across the upper front side flap 50, in which a longitudinally outer separation line defining the first removable section 100, i.e., the separation line 110, may at least partially define the first curved projection 90. The upper front side flap 52 may further comprise a corresponding second removable section 102 that is defined between two longitudinally spaced separation lines 112, 114 that extend substantially laterally across the upper front side flap 52, in which a longitudinally outer separation line defining the second removable section 102, i.e., the separation line 114, may at least partially define the second curved projection 92. The separation lines 108, 110, 112, 114 may be defined, for example, by a partial cut through at least one layer of the corrugated material or a cut line interrupted by short sections of bridging (uncut) material. The separation lines 108, 110, 112, 114 permit separation of the respective removable section 100, 102 from the upper front end flaps 50, 52, as described further below.

As shown in FIG. 1, a lateral outer edge of the first removable section 100 may comprise a cutout 100A extending inward in a substantially lateral direction from the first lateral edge 20 of the blank 10. A lateral outer edge of the second removable section 102 may similarly comprise a cutout 102A extending inward in a substantially lateral direction from the second lateral edge 22 of the blank 10. At least a portion of the first removable section 100 may taper in a direction away from the first lateral edge 20 of the blank 10, and at least a portion of the second removable section 102 may taper in a direction away from the second lateral edge 22 of the blank 10. In some examples, the first and second removable sections 100, 102 may taper substantially continuously from the respective lateral edge 20, 22 of blank 10, such that the first and second removable sections 100, 102 each form an elongated pie or wedge shape. As seen in FIG. 1, the first and second removable sections 100, 102 may taper in a direction extending from a respective one of the first or second lateral edges 20, 22 toward the first longitudinal end 16 of the blank 10.

One or both of the separation lines 108, 110 and 112, 114 defining the first and second removable sections 100, 102, respectively, may be curved. As shown in FIG. 1, the first removable section 100 extends between the first lateral edge 20 and the first longitudinal end 16 of the blank 10. The first removable section 100 may terminate adjacent to a junction 91 between a longitudinally outer edge of the first curved projection 90 and the first outer edge 94 of the upper front panel 30. The second removable section 102 similarly extends between the second lateral edge 22 and the first longitudinal end 16 of the blank 10. The second removable section 102 may terminate adjacent to a junction 93 between a longitudinally outer edge of the second curved projection 92 and the first outer edge 94 of the upper front panel 30.

In some examples, the first outer edge 94 of the upper front panel 30 (also referred to herein as an outwardly curved outer edge) may extend outwardly in the longitudinal direction L from the first longitudinal end 16 of the blank 10. In some particular examples, the first and second curved projections 90, 92 may each comprise a substantially continuous curve extending between a respective lateral edge 20, 22 and junction 91, 93, and the outwardly curved outer edge 94 may comprise a substantially continuously curve extending between the junctions 91, 93. In other particular examples, the junctions 91, 93 may each define a notch extending inwardly in the longitudinal direction L from the first longitudinal end 16 of the blank 10.

The second longitudinal end 18 of the blank 10 may be formed by a second outer edge 96 of the lower front panel 38 and longitudinally outer edges (not separately labeled) of the lower front side flaps 82, 84. The lower front side flaps 82, 84 may comprise a respective one of a first recess 116 and a second recess 118, in which the first and second recesses 116, 118 extend inwardly in the longitudinal direction L from the second longitudinal end 18 of the blank 10. In some examples, the second outer edge 96 of the lower front panel 38 (also referred to herein as an inwardly curved outer edge) may extend inwardly in the longitudinal direction L from the second longitudinal end 18 of the blank 10. In some particular examples, the first and second recesses 116, 118 may each comprise a substantially continuous curve extending between a respective lateral edge 20, 22 and a junction 83, 85 between the inwardly curved outer edge 96 and a respective longitudinally outer edge of the lower front side flaps 82, 84, and the inwardly curved outer edge 96 may comprise a substantially continuous curve extending between the junctions 83, 85. In other particular examples, the junctions 83, 85 may each define a point extending outwardly in the longitudinal direction L from the second longitudinal end 18 of the blank 10.

As described further below, the inwardly curved outer edge 96 of the lower front panel 38 corresponds to and is configured to receive the outwardly curved outer edge 94 of the upper front panel 30, and the first and second recesses 116, 118 correspond to and are configured to receive a respective one of the first and second curved projections 90, 92. In addition, the points formed in the second longitudinal end 18 of the blank 10 correspond to and are configured to be received in the notches formed in the first longitudinal end 16 of the blank 10.

Figure 2:
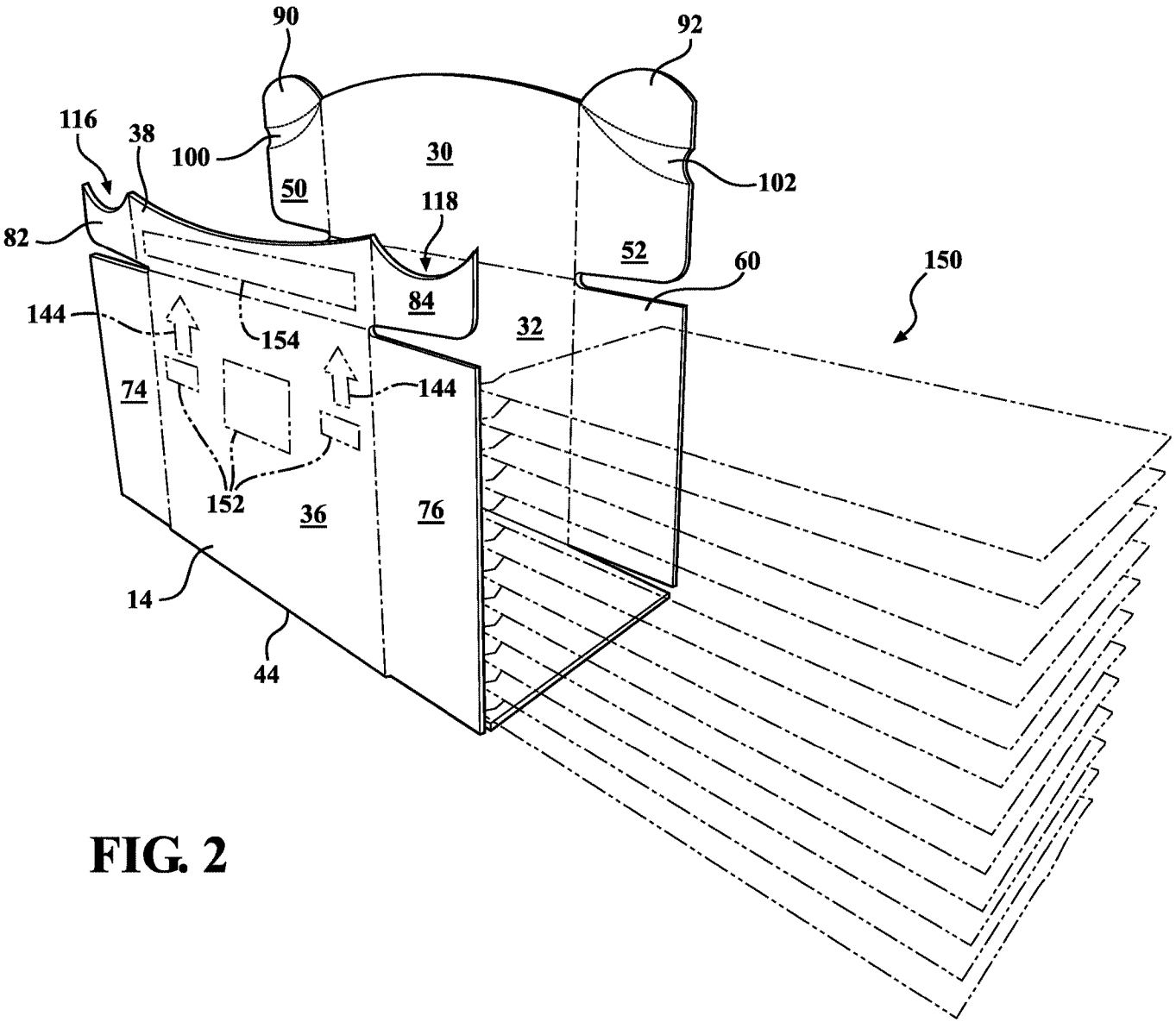
FIG. 2 is a perspective view of a product placed on the partially-assembled blank of FIG. 1 following initiation of a wraparound folding operation.
Figure 3:
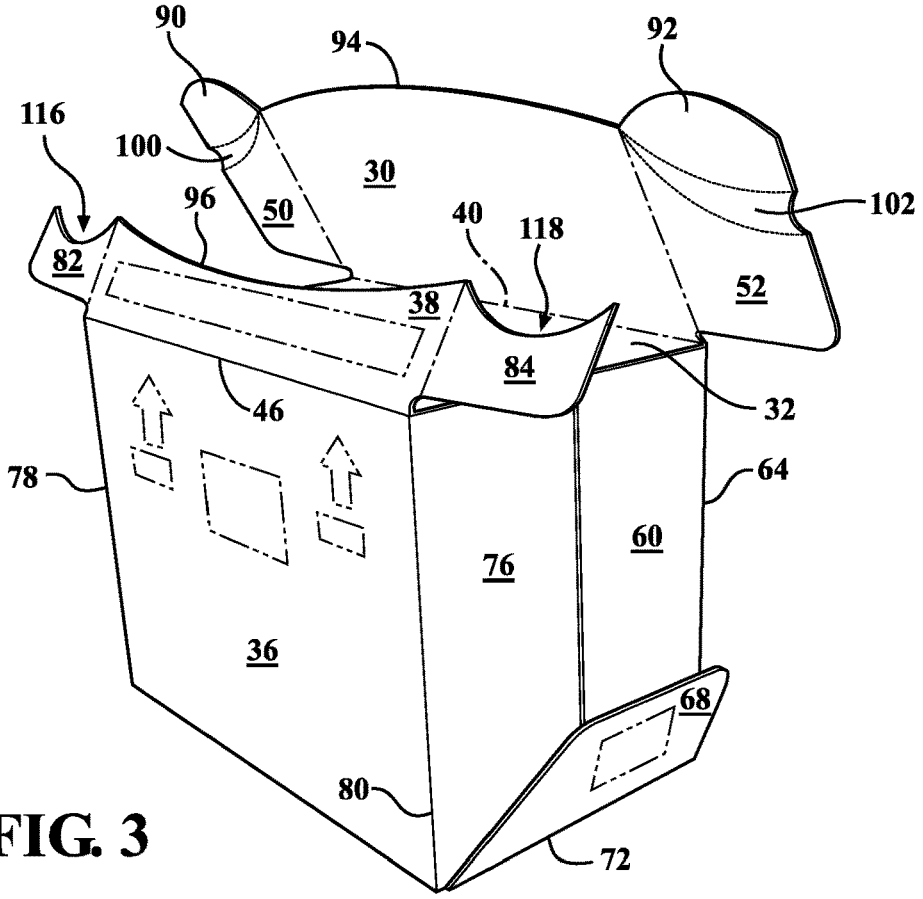
FIG. 3 is a perspective view illustrating partial completion of the wraparound folding operation using the blank of FIG. 2.
Figure 4:
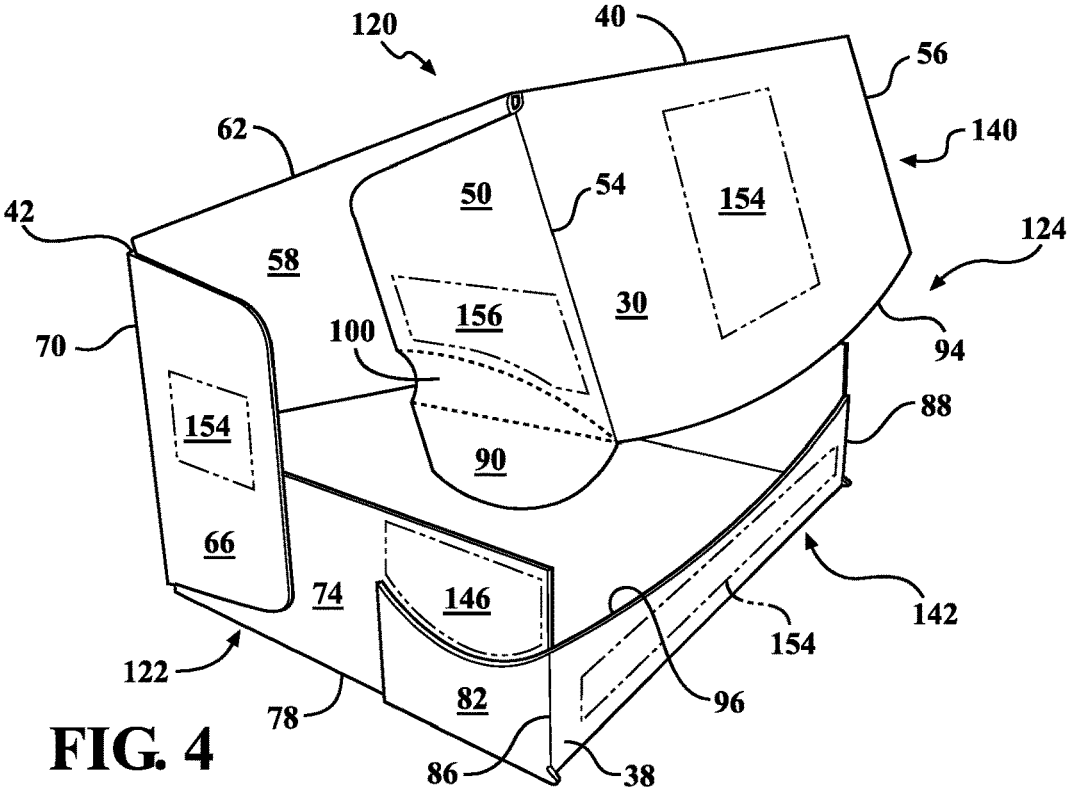
FIG. 4 is a perspective view of the blank of FIG. 3 prior to application of adhesive.

Referring to FIGS. 2-4, a series of folding steps for performing a wraparound folding operation using the blank 10 of FIG. 1 are described for forming the container 120 shown in FIGS. 5A and 5B. Although the procedures presented herein describe, for example, applying an "adhesive" forming a joint between adjacent flaps and panels or forming a "joint adhering" adjacent flaps and panels, it should be understood that such a joint or connection between the flaps and panels may be equivalently formed through other attachment mechanisms for connecting the flaps and panels together, and may alternatively encompass, without limitation, taping, stapling or stitching.

As illustrated in FIG. 2, the first and third main panels 32, 36 are folded upward from the second main panel 34 (not visible; see FIG. 1) along respective fold lines 42, 44 to a generally vertical position, e.g., at approximately 90° with respect to the second main panel 34. A product 150 to be packaged in the container 120 is placed on the second main panel 34 of the blank 10. The product 150 may be placed on the blank 10 prior to or after folding of one or both of the first and third main panels 32, 36.

As illustrated in FIG. 3, the first side flap 60 and the third side flap 76 along one edge of the blank 10, e.g., the second lateral edge 22 (see FIG. 1), are folded inward toward each other along their respective fold lines 64, 80 at approximately 90° with respect to the first main panel 32 and the third main panel 36, respectively. Adjacent edges of the first and third side flaps 60, 76 may abut one another or be spaced slightly apart, but there is no overlap between the first and third side flaps 60, 76. Subsequently, the second side flap 68 is folded upward from the second main panel 34 along its fold line 72 to a generally vertical position, e.g., at approximately 90° with respect to the second main panel 34, to overlap a portion of the respective outer surfaces of the first and third side flaps 60, 76. The second side flap 68 is depicted in a partially folded position in FIG. 3. Although not visible in FIG. 3, the first and third side flaps 58, 74 along the other edge of the blank 10, e.g., the first lateral edge 20 (see FIG. 1), are similarly folded toward each other along their respective fold lines 62, 78, after which the second side flap 66 is folded along its fold line 70 to overlap a portion of the respective outer surfaces of the first and third side flaps 58, 74 (see FIG. 4). As shown in FIG. 3, the upper and lower front panels 30, 38 are folded toward each other along their respective fold lines 40, 46 at approximately 90° with respect to the first main panel 32 and the third main panel 36, respectively. The upper and lower front panels 30, 38 are depicted in a partially folded position in FIG. 3.

FIGS. 4, 5A, and 5B depict the conclusion of the wraparound folding operation and application of adhesive, in which the container 120 is turned to illustrate various aspects of the container 120. The container 120 in FIG. 4 is also opened slightly to illustrate some aspects of the folding operation in more detail. As shown in FIGS. 4 and 5B, assembly of the container 120 is completed by folding the upper front side flap 50 along its fold line 54 to overlap a portion of the respective outer surfaces of the first and third side flaps 58, 74 and folding the lower front side flap 82 along its fold line 86 to overlap a portion of the outer surface of the third side flap 74. As shown in FIG. 5A, the upper front side flap 52 on the laterally opposed end of the upper front panel 30 is similarly folded along its fold line 56 (not labeled; see FIG. 1) to overlap a portion of the respective outer surfaces of the first and third side flaps 60, 76, and the lower front side flap 84 on the laterally opposed end of the lower front panel 38 is folded along its fold line 88 (not labeled; see FIG. 1) to overlap a portion of the outer surface of the third side flap 76.

As shown in FIGS. 4 and 5B, a first end 122 of the container 120 is formed by the side flaps located along the first lateral edge 20 of the blank 10 (see FIG. 1), e.g., the upper front side flap 50, the first side flap 58, the second side flap 66, the third side flap 74, and the lower front side flap 82. As shown in FIG. 5A, a second end 124 of the container 120 is formed by the side flaps located along the second lateral edge 22 of the blank 10 (see FIG. 1), e.g., the upper front side flap 52, the first side flap 60, the second side flap 68, the third side flap 76, and the lower front side flap 84. In particular, the upper front side flaps 50, 52 and the lower front side flaps 82, 84 overlap at least a portion of respective ones of the first and third side flaps 58, 60, 74, 76, as described herein. The upper and lower front panels 30, 38 together may generally form a first side or face 160 of the container 120, and the first main panel 32 may generally form a second side or face 162 of the container 120, as shown in FIG. 5B. As shown in FIG. 5A, the second main panel 34 may generally form a third side or face 164 of the container 120, and the third main panel 36 may generally form a fourth side or face 166 of the container 120.

The first end 122 of the container 120 extends between a first junction 161 of the first side 160 and the first end 122 of the container 120 and a second junction 163 of the third side 164 and the first end 122 of the container 120, as shown in FIGS. 5A and 5B. The second end 124 of the container 120 extends between a third junction 165 of the first side 160 and the second end 124 of the container 120 and a fourth junction 167 of the third side 164 and the second end 124 of the container 120. An overlapping area between the upper front side flap 50 and the third side flap 74 is generally depicted in FIG. 4 as an overlap area 146. In particular, the overlap area 146 is formed by an overlap between the first curved projection 90 and the third side flap 74. A corresponding overlap area (not visible) is formed by the overlap between the second curved projection 92 and the third side flap 76 (see FIG. 6). The second side flaps 66, 68 and the upper and lower front side flaps 50, 52, 82, 84 extend only partially across the respective first or second end 122, 124 of the container 120 such that at least a section of a seam between the adjacent edges of respective pairs of the first and third side flaps 58, 74 and 60, 76 is exposed. In particular, as best seen in FIGS. 5A and 5B, the first and second removable sections 100, 102 each extend across only a portion of a respective one of the first end 122 or the second end 124 of the container 120, i.e., the first removable section 100 extends across only a portion of the distance between the first and second junctions 161, 163 and the second removable section 102 extends across only a portion of the distance between the third and fourth junctions 165, 167. The first and second removable sections 100 and 102 also extend across only a portion of respective ones of the first and third side flaps 58, 60, 74, 76. The first removable section 100 terminates adjacent to the first junction 161 of the first side 160 and the first end 122 of the container 120, and the second removable section 102 terminates at the third junction 165 of the first side 160 and the second end 124 of the container 120. At least a portion of each of the first and second removable sections 100, 102 may taper in a direction extending from the third side 164 of the container 120 toward the first side 160 of the container 120. In some examples, the first and second removable sections 100, 102 may taper substantially continuously in the direction extending from the third side 164 toward the first side 160.

As shown in FIGS. 4 and 5B, the container 120 comprises a first portion 140 (also referred to herein as a lid portion) defined by the upper front panel 30 and the first main panel 32, i.e., the first section 24 of the blank 10 shown in FIG. 1. The container 120 further comprises a second portion 142 (also referred to herein as a base portion) defined by the second main panel 34, the third main panel 36, and the lower front panel 38, i.e., the second section 26 of the blank 10.

As shown in FIG. 5B with reference to the first end 122 of the container 120, adhesive may be applied to multiple locations to close the container 120. Adhesive may be applied between the overlapping portion of the second side flap 66 and the third side flap 74, depicted generally as adhesive area 126, to form a joint adhering the flaps 66, 74 to one another at the overlapping portion. Adhesive may also be applied between the overlapping portion of the lower front side flap 82 and the third side flap 74, depicted generally as adhesive area 128, to form a joint adhering the flaps 74, 82 to one another at the overlapping portion. Adhesive may further be applied to a portion of the overlap between the upper front side flap 50 and the first side flap 58, depicted generally as adhesive area 130, to form a joint adhering the flaps 50, 58 to one another at the overlapping portion. Adhesive may further be applied to a portion of the overlap between the upper front side flap 50 and the third side flap 74, depicted generally as adhesive area 132, to form a joint adhering the flaps 50, 74 to one another at the overlapping portion. Although not shown in FIG. 5B, adhesive is similarly applied between the corresponding overlapping portions of the flaps 52, 60, 68, 76, 84 on the second end 124 of the container 120.

In general, the adhesive areas 126-132 depicted in FIG. 5B are the only areas where adhesive is applied on the first end 122 of the container 120. In particular, with reference to the first end 122 of the container 120, it should be noted that adhesive applied in the adhesive area 126 does not extend to any portion of the second side flap 66 that overlaps the first side flap 58, such that the portion of the second side flap 66 that overlaps the first side flap 58 is without a joint adhering these portions of the flaps 58, 66 together. Adhesive applied in the adhesive area 130 does not extend to any portion of the upper front side flap 50 that overlaps the third side flap 74, including the first removable section 100. Adhesive applied in the adhesive area 132 does not extend to any portion of the upper front side flap 50 that overlaps the first side flap 58. In particular, the upper front side flap 50 is adhered to the third side flap 74 only at the joint formed between the curved projection 90 and the third side flap 74. Although not shown, adhesive is applied in a similar manner to corresponding areas on the second end 124 of the container 120. Thus, following application of the adhesive and closure of the container 120, the first portion 140 of the container 120 is connected to the second portion 142 only at the fold/separation line 42 and the portion of the curved projections 90, 92 that overlap and are adhered to respective ones of the third side flaps 74, 76, e.g., overlap area 146 shown in FIG. 4.

In the completed container 120 shown in FIG. 5B, the outwardly curved outer edge 94 of the upper front panel 30 is received in the inwardly curved outer edge 96 of the lower front panel 38. The outer edges 94, 96 may abut one another or be adjacent to one another and spaced slightly apart, but there is no overlap between the upper and lower front panels 30, 38. As shown in FIGS. 5A and 5B, the first and second curved projections 90, 92 formed on the upper front side flaps 50, 52 are received in the first recess 116 (not labeled; see FIG. 1) and the second recess 118, respectively, formed in the lower front side flap 82. The first removable section 100 spans at least a portion of the seam between the first and third side flaps 58, 74 on the first end 122 of the container 120, and the second removable section 102 spans at least a portion of the seam between the first and third side flaps 60, 76 on the second end 124. Adjacent edges of respective ones of the first and second curved projections 90, 92 and the first and second recess 116, 118 may abut one another or be spaced slightly apart but there is no overlap between respective ones of the upper and lower front side flaps 50, 52, 82, 84.

The completed container 120, which may be a shipping container, is transported in a first orientation (also referred to herein as a shipping orientation) shown in FIG. 5B. It is noted that the shipping container 120 is also generally loaded and assembled in the shipping orientation, as shown in FIGS. 2 and 3. As shown in FIGS. 2, 3, 5A, 5B, and 6, one or both of the first and/or third main panels 32, 36 may include arrows 144 printed on an outer surface of the panel 32, 36 to indicate an "up" position for shipping. During transport, the second main panel 34 (not visible; see FIG. 1) forms a bottom panel on which the shipping container 120 rests, and the upper and lower front panels 30, 38 together form a top panel on which additional shipping containers 120 or other containers or objects may be stacked. Rigidity of the shipping container 120 is maintained by the joints formed between the first and third side flaps 58, 60, 74, 76 and respective ones of the second side flaps 66, 68 and the upper and/or lower front side flaps 50, 52, 82, 84, as described herein. In particular, the joints between the upper front side flaps 50, 52 and the third side flaps 74, 76, and more specifically the joints formed by the overlapping areas of the curved projections 90, 92 and the third side flaps 74, 76 (see the overlap area 146 in FIG. 4), provide enhanced rigidity without interfering with conversion of the shipping container 120 for display, as described below.

Figure 6:
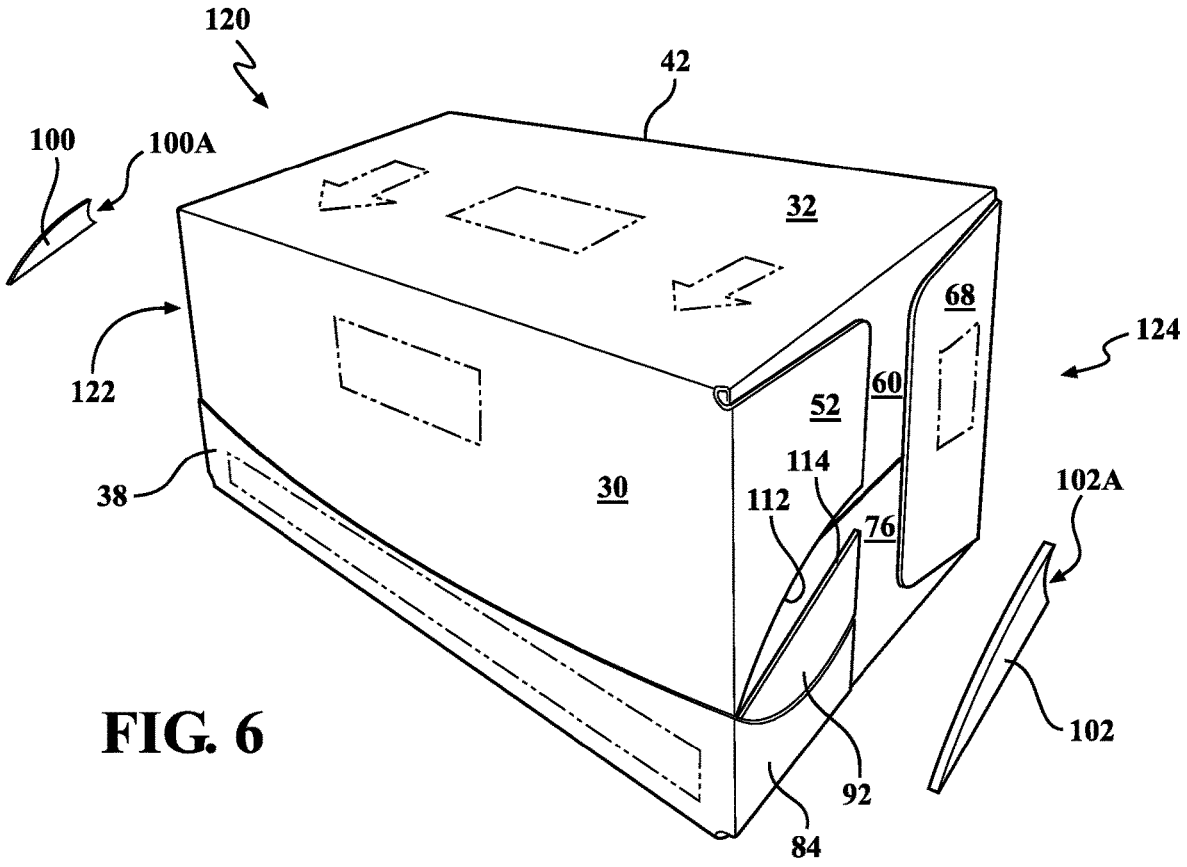
FIG. 6 is a perspective view illustrating reconfiguration of the shipping container of FIGS. 5A and 5B to form a display container.
Figure 7:
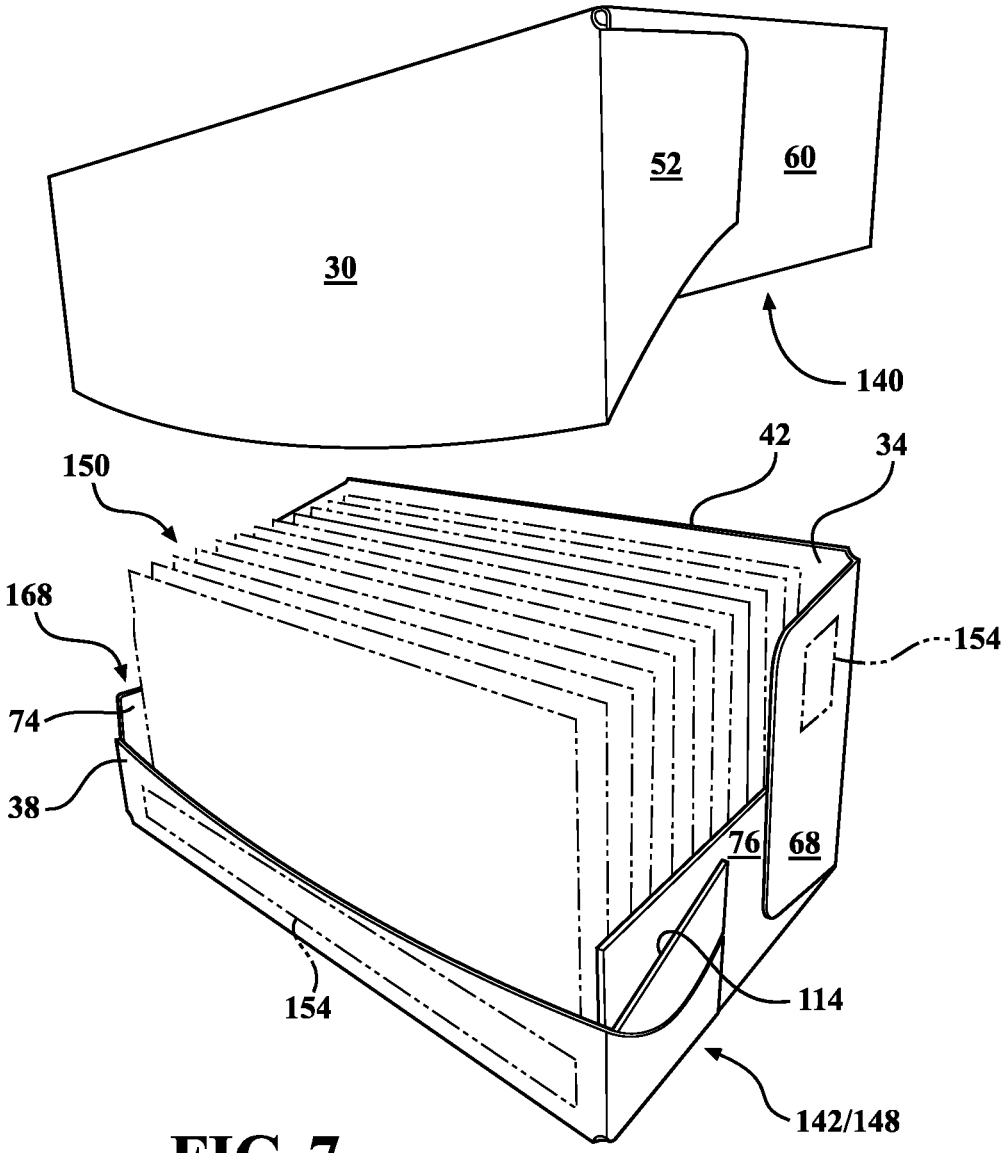
FIG. 7 is a perspective view illustrating removal of a lid portion to complete formation of the display container.

The shipping container 120 may be converted to a display case 148 for displaying the product 150 shipped therein. FIGS. 6 and 7 illustrate a process for reconfiguring the shipping container 120 to the display case 148. To begin the process, the shipping container 120 is turned 90° from the first orientation shown in FIG. 5B to a second orientation (also referred to herein as a display orientation) shown in FIG. 6, in which the third main panel 36 (not visible; see FIG. 1) forms a bottom panel. A user then grasps the first and second removable sections 100, 102 and pulls them toward the upper and lower front panels 30, 38 to remove the first and second removable sections 100, 102 along their respective separation lines 108, 110, 112, 114, as shown in FIG. 6 (only the separation lines 112, 114 for the second removable section 102 are visible in FIG. 6; see FIG. 1). The cutouts 100A, 102A may assist the user with locating and grasping the first and second removable sections 100, 102. Following removal of the removable sections 100, 102, the first and second curved projections 90, 92 detach from the lid portion 140, e.g., from remaining sections of the upper front side flaps 50, 52, and remain adhered to the base portion 142 of the shipping container 120, e.g., to the outer surfaces of respective ones of the third side panels 74, 76 (only the second curved projection 92 and third side panel 76 are visible in FIG. 6; see FIG. 5B). The shipping container 120 may now be opened as a clamshell with the lid portion 140 being pivotally connected to the base portion 142 only at the second fold line 42 (see, for example, FIG. 4). The lid portion 140 is otherwise unattached, e.g., without glue or other adhesive, to the base portion 142.

As shown in FIG. 7, following removal of the first and second removable sections 100, 102, the lid portion 140 of the shipping container 120 may be completely detached or separated from the base portion 142 along the separation line defined at the second fold line 42 to complete formation of the display case 148 with no additional cutting or tearing required. An internal space 168 defined by the display case 148 is completely open on top, e.g., the entire second side 162 defined by the first main panel 32 (see FIG. 5B) is removed. The base portion 142 of the shipping container 120 thus forms the display case 148, which may be used to display the product 150 at a point of sale. The shipping container 120 may be converted to the display case 148 entirely by hand without the need for knives or other cutting tools and without damaging, removing, or otherwise disturbing the product 150 contained in the shipping container 120. With the exception of the separation lines 42, 110, 114, all exposed surfaces of the display case 148 have clean edges that are not disrupted or marred by separation from the lid portion 140, as the only connections between the lid and base portions 140, 142 are at the separation line 42 between the first and second main panels 32, 34 and the portions of the curved projections 90, 92 that overlap and are adhered to respective ones of the third side flaps 74, 76, e.g., overlap area 146 as shown in FIG. 4.

As shown in FIGS. 2-7, outer surfaces of one or more of the panels and/or side flaps (e.g., the outer surface 14 of the blank 10) may include one or more regions with printed information in the form of advertising (e.g., text and/or graphics in the form of trademarks, service marks, slogans, etc.), instructions in the form of text and/or graphics for how to assemble, ship, and open the shipping container 120, and other graphics such as pictures, drawings, etc. For example, the outer surface of the first and/or third main panels 32, 36 may include arrows 144 and/or one or more regions 152 with text and/or graphics indicating how to transport the shipping container 120 and convert it for display. The outer surface of one or more of the second side panels 66, 68, the upper front panel 30, or the lower front panel 38 may include regions 154 with text and/or graphics. The outer surface of the upper front side flaps 50, 52 may include regions 156 with text and/or graphics indicating how to open the shipping container 120.

One or more of these regions 152, 154, 156 may be located such that they remain visible when the shipping container 120 is converted to the display container 148, as shown in FIG. 7. For example, at the point of sale, the display case 148 would typically be placed such that the lower front panel 38 forms a front panel that is visible to people, such as customers, who wish to view and access the product 150. In addition, the longitudinal length of the lower front panel 38 may selected to be less than all other panels and side flaps 34, 36, 66, 68, 74, 76 forming the display case 148 such that the product 150 is clearly visible and easily accessible from a front side, while still being secured on the other sides of the display case 148. The outer surfaces of one or more of the panels and/or side flaps may also comprise one or more different colors (not shown).

It should be understood that, although the present description references use of the container 120 at a point of sale, use of the container 120 is not limited to this particular application and may be implemented for other shipping operations.

Figure 8:
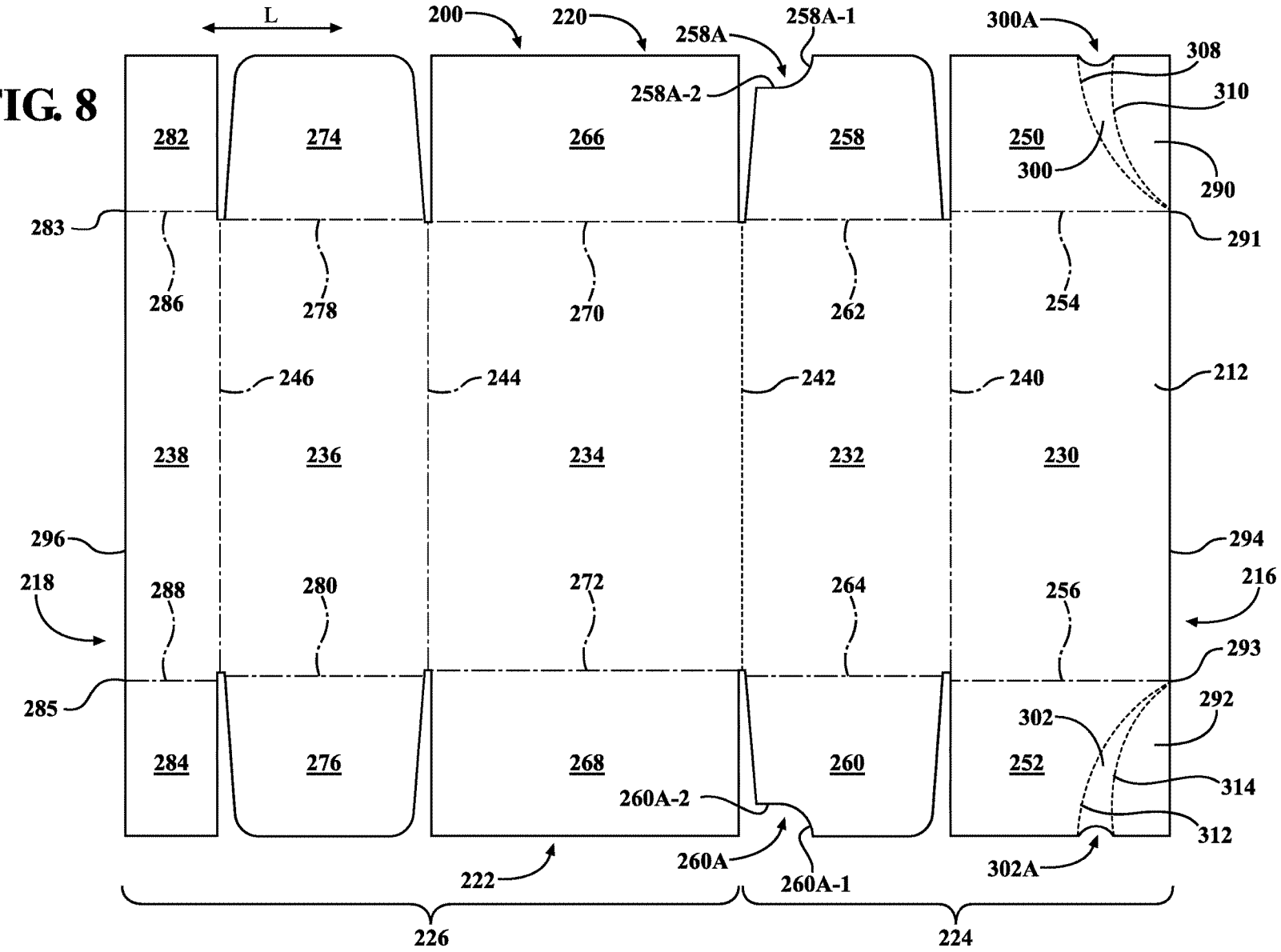
FIG. 8 is a plan view of an alternative configuration of a blank for forming a shipping container.
Figure 12:
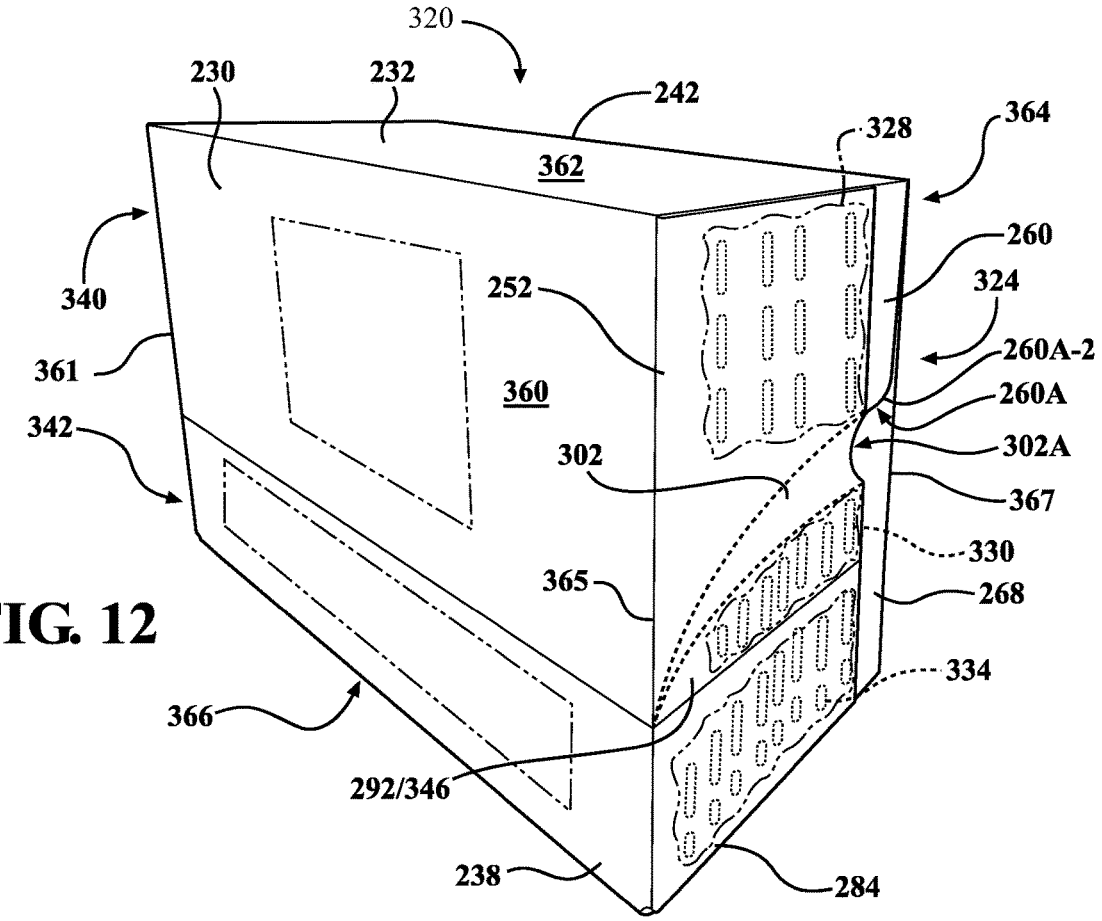
FIG. 12 is a perspective view illustrating a completed shipping container.

Referring to FIG. 8, an alternative configuration of a one-piece blank 200 is shown for illustrating one or more aspects of a shipping container 320 described herein (see FIG. 12). The blank 200 may be substantially similar to the blank 10 described above and may be formed of a corrugated cardboard material that may be die cut to the shape shown herein. The blank 200 illustrated in FIG. 8 is a planar piece of material in which an inner surface 212 is shown facing out of the page and an outer surface 214 (see FIG. 9) is facing an opposite direction from the inner surface 212. The blank 200 extends in a longitudinal direction L between first and second longitudinal ends, generally designated 216 and 218, respectively, and further extends in a lateral direction between first and second lateral edges, generally designated 220 and 222, respectively. The blank 200 comprises a plurality of panels connected in series at respective fold lines.

The blank 200 may comprise an upper front panel 230, a first main panel 232, a second main panel 234, a third main panel 236, and a lower front panel 238. The blank 200 may include a first section 224 and a second section 226, in which the first section 224 comprises the upper front and first main panels 230, 238, and the second section 226 comprises the second and third main panels 234, 236 and the lower front panel 238. A longitudinal length of the first main panel 232, extending in the longitudinal direction L, may be substantially equal to a longitudinal length of the third main panel 236. A longitudinal length of the second main panel 234 may be substantially equal to a combined longitudinal length of the upper and lower front panels 230, 238. A longitudinal length of the lower front panel 238 may be less than a longitudinal length of the upper front panel 230. In some examples, the longitudinal length of the lower front panel 238 may be ≤50% of the longitudinal length of the upper front panel 230. In other examples, the longitudinal length of the lower front panel 238 may be less than the longitudinal length of any of the other individual panels 230, 232, 234, 236.

With continued reference to FIG. 8, the panels 230, 232, 234, 236, 238 of the blank 200 are connected in series, in which fold lines are represented by a dashed line and separation or tear lines are represented by a dash-dot line. The upper front panel 230 is connected to the first main panel 232 at a lateral fold line 240 (also referred to herein as a first fold line), the first main panel 232 is connected to the second main panel 234 at a lateral fold line 242 (also referred to herein as a second fold line), the second main panel 234 is connected to the third main panel 236 at a lateral fold line 244 (also referred to herein as a third fold line), and the lower front panel 238 is connected to the third main panel 236 at a lateral fold line 246 (also referred to herein as a fourth fold line). The second fold line 242 between the first and second main panels 232, 234 also comprises a separation line that may be defined, for example, by a partial cut through at least one layer of the corrugated material or a cut line interrupted by short sections of bridging (uncut) material. As will be further understood from the description below, the separation line defined at the second fold line 242 forms a structurally weakened line that may permit separation of the first main panel 232 from the second main panel 234, such that the first section 224 of the blank 200 is separable from the second section 226 along the second fold line 242.

The upper front panel 230 comprises upper front side flaps 250, 252 that are foldably joined to laterally opposed ends of the upper front panel 230 along respective longitudinal fold lines 254, 256. The first main panel 232 comprises first side flaps 258, 260 that are foldably joined to laterally opposed ends of the first main panel 232 along respective longitudinal fold lines 262, 264. The first side flaps 258, 260 each comprise a respective cutout 258A, 260A extending inward from a lateral outer edge of the respective first side flap 258, 260. As shown in FIG. 8, the cutouts 258A, 260A may be formed in one corner of the first side flap 258, 260. The cutout 258A may comprise a substantially laterally extending section 258A-1 and a substantially longitudinally extending section 258A-2. The cutout 260A may similarly comprise a substantially laterally extending section 260A-1 and a substantially longitudinally extending section 260A-2. The second main panel 234 comprises second side flaps 266, 268 that are foldably joined to laterally opposed ends of the second main panel 234 along respective longitudinal fold lines 270, 272. The third main panel 236 comprises third side flaps 274, 276 that are foldably joined to laterally opposed ends of the third main panel 236 along respective longitudinal fold lines 278, 280. The lower front panel 238 comprises lower front side flaps 282, 284 that are foldably joined to laterally opposed ends of the lower front panel 238 along respective longitudinal fold lines 286, 288.

As shown in FIG. 8, the upper front side flap 250 of the upper front panel 230 may comprise a first longitudinally outer section 290, and the upper front side flap 252 may comprise a corresponding second longitudinally outer section 292. The upper front side flap 250 may further comprise a first removable section 300 that is defined between two longitudinally spaced separation lines 308, 310 that extend substantially laterally across the upper front side flap 250, in which a longitudinally outer separation line, e.g., separation line 310, defining the first removable section 300 may at least partially define the longitudinally outer section 290. The upper front side flap 252 may further comprise a corresponding second removable section 302 that is defined between two longitudinally spaced separation lines 312, 314 that extend substantially laterally across the upper front side flap 252, in which a longitudinally outer separation line, e.g., separation line 314, defining the second removable section 302 may at least partially define the second longitudinally outer section 292. The separation lines 308, 310, 312, 314 may be defined, for example, by a partial cut through at least one layer of the corrugated material or a cut line interrupted by short sections of bridging (uncut) material. The separation lines 308, 310, 312, 314 permit separation of the respective removable sections 300, 302 from the upper front end flaps 250, 252, as described further below.

With continued reference to FIG. 8, a lateral outer edge of the first removable section 300 may comprise a cutout 300A extending inward in a substantially lateral direction from the first lateral edge 220 of the blank 200. A lateral outer edge of the second removable section 302 may similarly comprise a cutout 302A extending inward in a substantially lateral direction from the second lateral edge 222 of the blank 200. At least a portion of the first removable section 300 may taper in a direction away from the first lateral edge 220 of the blank 200, and at least a portion of the second removable section 302 may taper in a direction away from the second lateral edge 222 of the blank 200. In some examples, the first and second removable sections 300, 302 may taper substantially continuously from the respective lateral edge 220, 222 of the blank 200, such that the first and second removable sections 300, 302 each form an elongated pie or wedge shape. As seen in FIG. 8, the first and second removable sections 300, 302 may taper in a direction extending from a respective one of the first or second lateral edges 220, 222 toward the first longitudinal end 216 of the blank 200.

One or both of the separation lines 308, 310 and 312, 314 defining the first and second removable sections 300, 302, respectively, may be curved. As shown in FIG. 8, the first removable section 300 extends between the first lateral edge 220 and the first longitudinal end 216 of the blank 200. The first removable section 300 may terminate adjacent to a junction 291 between a longitudinally outer edge of the first longitudinally outer section 290 and the first outer edge 294 of the upper front panel 230. The second removable section 302 similarly extends between the second lateral edge 222 and the first longitudinal end 216 of the blank 200. The second removable section 302 may terminate adjacent to a junction 293 between a longitudinally outer edge of the second longitudinally outer section 292 and the first outer edge 294 of the upper front panel 230.

The first longitudinal end 216 of the blank 200 may be formed by a first outer edge 294 of the upper front panel 230 and longitudinally outer edges (not separately labeled) of the longitudinally outer sections 290, 292. The second longitudinal end 218 of the blank 200 may be formed by a second outer edge 296 of the lower front panel 238 and longitudinally outer edges (not separately labeled) of the lower front side flaps 282, 284. In some examples as shown in FIG. 8, the first outer edge 294 of the upper front panel 230 may extend between the junctions 291, 293 in a substantially straight line in a lateral direction, and the longitudinally outer edges of the first and second longitudinally outer sections 290, 292 may extend in a substantially straight line in a lateral direction between a respective lateral edge 220, 222 and junction 291, 293, such that the first longitudinal end 216 of the blank 200 comprises a substantially straight outer edge. The second outer edge 296 may extend in a substantially straight line in a lateral direction between junctions 283, 285 between the second outer edge 296 and the longitudinally outer edge of respective ones of the lower front side flaps 282, 284, and the longitudinally outer edges of the lower front side flaps 282, 284 may extend in a substantially straight line in a lateral direction between a respective lateral edge 220, 222 and junction 283, 285, such that the second longitudinal end 218 of the blank 200 comprises a substantially straight outer edge.

In other examples (not shown), the first outer edge 294 and/or the longitudinally outer edges of the first and second longitudinally outer sections 290, 292 may curve outwardly in the longitudinal direction L, and the second outer edge 296 and/or the longitudinally outer edges of the lower front side flaps 282, 284 may correspondingly curve inwardly in the longitudinal direction L (see FIG. 1). As described further below, the second outer edge 296 of the lower front panel 238 abuts or is adjacent to the first outer edge 294 of the upper front panel 230, and the respective longitudinally outer edges of the first and second longitudinally outer sections 290, 292 and the lower front side flaps 282, 284 abut or are adjacent to one another in the assembled shipping container 320 (see FIG. 12).

Figure 9:
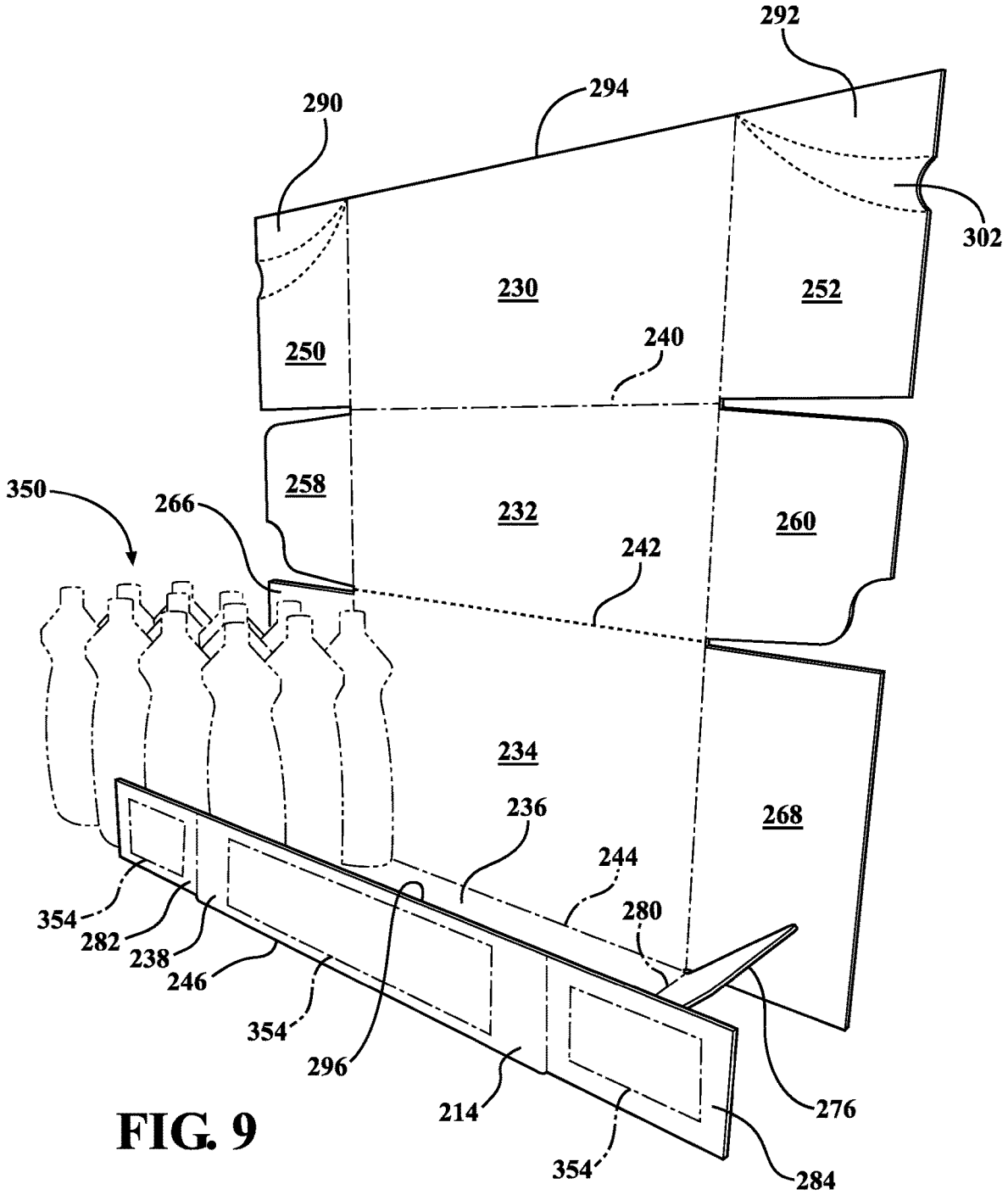
FIG. 9 is a perspective view of a product placed on the partially-assembled blank of FIG. 8 following initiation of a wraparound folding operation.
Figure 10:
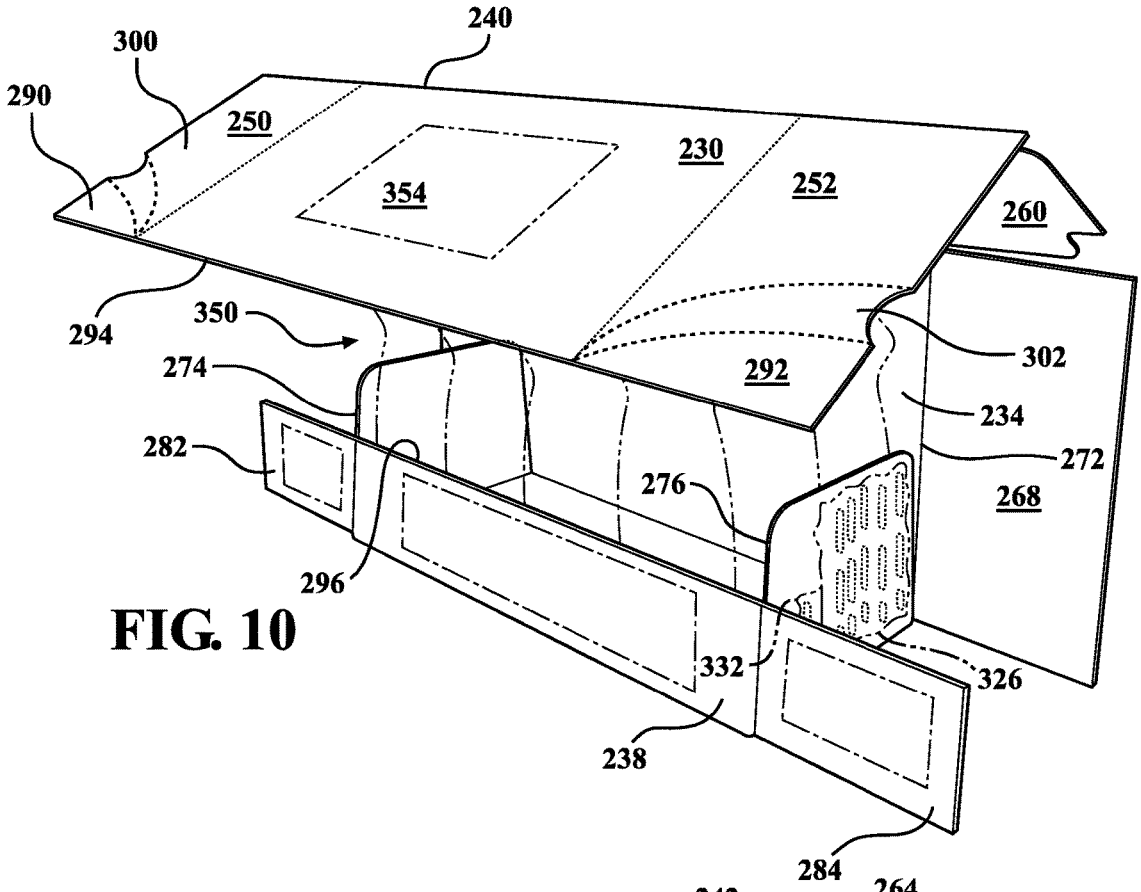
FIG. 10 is a perspective view illustrating partial completion of the wraparound folding operation using the blank of FIG. 9.
Figure 11:
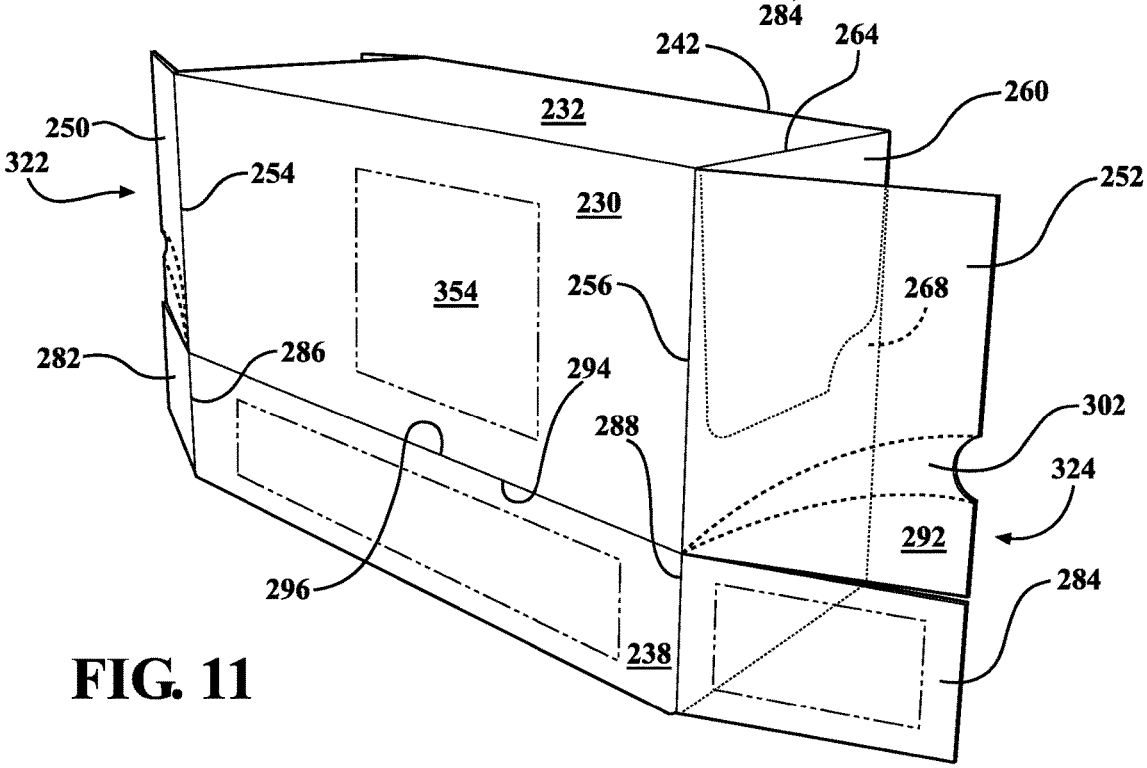
FIG. 11 is a perspective view illustrating a final step in completion of the wraparound folding operation using the blank of FIG. 10 prior to application of adhesive.

Referring to FIGS. 9-11, a series of folding steps for performing a wraparound folding operation using the blank 200 of FIG. 8 is described for forming the container 320 shown in FIG. 12. As illustrated in FIG. 9, the third main panel 236 comprises a bottom panel on which a product 350 to be packaged is placed. The lower front panel 238 is folded upward from the third main panel 236 along its fold line 246 to a generally vertical position, e.g., at approximately 90° with respect to the third main panel 236. The remaining panels of the blank 200, i.e., the upper front panel 230 and the first and second main panels 232, 234 are folded upward along the fold line 244 between the second and third main panels 234, 236 to a generally vertical position, e.g., such that the panels 230, 232, 234 are at approximately 90° with respect to the third main panel 236. The product 350 may be placed on the blank 200 prior to or after folding of one or both of the lower front panel 238 or the panels 230, 232, 234 along the fold line 244. The third side flap 276 is folded upward along its fold line 280 to a generally vertical position, e.g., at approximately 90° with respect to the third main panel 236. In FIG. 9, the third side flap 276 is depicted in a partially folded position, and FIG. 10 depicts the third side flap 276 in its fully folded position. Although not visible in FIG. 9, the third side flap 274 on the first lateral edge 220 is similarly folded upward along its fold line 278 to a generally vertical position, e.g., at approximately 90° with respect to the third main panel 236 (see FIGS. 8 and 10).

With reference to FIGS. 10 and 11, the upper front panel 230 is folded toward the lower front panel 238 by folding the first main panel 232 along the fold line 242 and folding the upper front panel 230 along the fold line 240. Folding of the first main panel 232 and the upper front panel 230 may occur substantially simultaneously or in sequence. FIG. 10 depicts the upper front and first main panels 230, 232 in a partially folded position. FIG. 11 depicts the upper front and first main panels 230, 232 in their fully folded positions, in which the first main panel 232 is at approximately 90° with respect to the second main panel 234 and is substantially parallel to the third main panel 236 (not visible; see FIG. 9), the upper front panel 230 is at approximately 90° with respect to the first main panel 232, and the respective outer edges 294, 296 of the upper and lower front panels 230, 238 may abut or are adjacent to, but do not overlap, one another.

Following folding of the upper front panel 230 such that the outer edges 294, 296 of the upper and lower front panels 230, 238 abut one another, the second side flap 268 on one edge of the blank 200, i.e., the second lateral edge 222 (see FIG. 8) is folded inward along its fold line 272 at approximately 90° with respect to the second main panel 234, as shown in FIGS. 10 and 11. When fully folded, the second side flap 268 overlaps a portion of an outer surface of the third side flap 276. Subsequently, the first side flap 260 on the second lateral edge 222 is folded downward along its fold line 264 at approximately 90° with respect to the first main panel 232. When fully folded, the first side flap 260 overlaps a portion of an outer surface of the second side flap 268, as shown in FIG. 11. Although not visible in FIGS. 10 and 11, the corresponding second side flap 266 on the opposite edge, e.g., the first lateral edge 220, is similarly folded inward along its fold line 270 to overlap a portion of an outer surface of the third side flap 274, and the first side flap 258 is similarly folded downward along its fold line 262 to overlap a portion of an outer surface of the second side flap 266 (see FIG. 8).

As shown in FIG. 11, the wraparound folding operation is completed by folding the upper and lower front side flaps 250, 282 along the first lateral side 220 (see FIG. 8) inward along their respective fold lines 254, 286 at approximately 90° with respect to the upper and lower front panels 230, 238. The corresponding upper and lower front side flaps 252, 284 on the second lateral side 222 are folded inward along their respective fold lines 256, 288 at approximately 90° with respect to the upper and lower front panels 230, 238. As shown in FIGS. 11 and 12, a first end 322 of the container 320 is formed by the side flaps located along the first lateral edge 220 of the blank 200 (see FIG. 8), e.g., the upper front side flap 250, the first side flap 258, the second side flap 266, the third side flap 274, and the lower front side flap 282. A second end 324 of the container 320 is formed by the side flaps located along the second lateral edge 222 of the blank 200 (see FIG. 8), e.g., the upper front side flap 252, the first side flap 260, the second side flap 268, the third side flap 276, and the lower front side flap 284. In particular, the upper front side flaps 250, 252 and the lower front side flaps 282, 284 overlap at least a portion of respective ones of first, second, and third side flaps 258, 260, 266, 268, 274, 276, as described herein. The upper and lower front panels 230, 238 together may generally form a first side or face 360 of the container 320; the first main panel 232 may generally form a second side or face 362 of the container 320; the second main panel 234 may generally form a third side or face 364 (see also the corresponding third side 164 of the container 120 shown in FIG. 5A); and the third main panel 236 may generally form a fourth side or face 366 (see also the corresponding fourth side 166 of the container 120 shown in FIG. 5A).

As shown in FIG. 12 with respect to the second end 324 of the container 320, when fully folded, the upper front side flap 252 overlaps a portion of the respective outer surfaces of the first side flap 260, the second side flap 268, and the third side flap 276 (not visible). The lower front side flap 284 overlaps a portion of the respective outer surfaces of the second side flap 268 and the third side flap 276. Adjacent edges of the upper and lower front side flaps 252, 284 abut, but do not overlap, each other. The upper front side flap 252 may overlap the first side flap 260 such that the cutout 302A formed in the second removable section 302 is adjacent to the cutout 260A formed in the first side flap 260. In particular, the cutout 302A is adjacent to the substantially longitudinally extending section 260A-2 of the cutout 260A. Although not visible in FIG. 12, the upper front side flap 250 on the opposite end 322 of the container 320 may overlap the first side flap 258 such that the cutout 300A formed in the first removable section 300 is similarly adjacent to the cutout 258A formed in the first side flap 258, and in particular, the cutout 302A is adjacent to the substantially longitudinally extending section 258A-2 of the cutout 258A (see FIG. 8).

With reference to FIGS. 11 and 12, the first end 322 of the container 320 extends between a first junction 361 of the first side 360 and the first end 322 of the container 320 and a second junction (not visible; see the corresponding second junction 163 of the container 120 shown in FIG. 5B) of the third side 364 and the first end 322 of the container 320. The second end 324 of the container 320 extends between a third junction 365 of the first side 360 and the second end 324 of the container 320 and a fourth junction 367 of the third side 364 and the second end 324 of the container 320. The upper and lower front side flaps 250, 252, 282, 284 extend only partially across the respective first or second end 322, 324 of the container 320. In particular, as best seen in FIG. 12, the second removable section 302 extends across only a portion of the second end 324 of the container 320, i.e., extends across only a portion of the distance between the third and fourth junctions 365 and 367, with the second removable section 302 terminating adjacent to the third junction 365 of the container 320. Although not visible in FIG. 12, the first removable section 300 similarly extends across only a portion of the first end 322 of the container 320, i.e., extends across only a portion of the distance between the first and second junctions 361 (only the first junction is visible in FIG. 12), with the first removable section 300 terminating at the first junction 361 of the container 320 (see FIGS. 1, 10, and 11). The first and second removable sections 300 and 302 also extend across only a portion of the first side flaps 258, 260 and the second side flaps 266, 268. At least a portion of each of the first and second removable sections 300, 302 may taper in a direction extending from the third side 364 toward the first side 360 of the container 320. In some examples, the first and second removable sections 300, 302 may taper substantially continuously in the direction extending from the third side 364 toward the first side 360.

The completed container 320 as shown in FIG. 12 comprises a first portion 340 (also referred to herein as a lid portion) defined by the upper front panel 230 and the first main panel 232, i.e., the first section 224 of the blank 200 shown in FIG. 8. The container 320 further comprises a second portion 342 (also referred to herein as a base portion) defined by the second main panel 234, the third main panel 236, and the lower front panel 238, i.e., the second section 226 of the blank 200.

Adhesive may be applied to multiple locations to close the container 320, as shown in FIGS. 10 and 12 with respect to the second end 324 of the container 320. Because the third side flap 276 is covered at least partially by the second side flap 268 and the lower front side flap 284 in the assembled container 320, the relevant adhesive application areas are depicted in FIG. 10. All other adhesive application areas are depicted in FIG. 12. With reference to FIG. 10, adhesive may be applied between the overlapping portion of the third side flap 276 and the second side flap 268, depicted generally as adhesive area 326, to form a joint adhering the flaps 268, 276 to one another at the overlapping portion. With reference to FIG. 12, adhesive may be applied to a portion of the overlap between the upper front side flap 252 and the first side flap 260, depicted generally as adhesive area 328, to form a joint adhering the flaps 252, 260 to one another at the overlapping portion. Adhesive may also be applied to a portion of the overlap between the upper front side flap 252 and the second side flap 268, depicted as adhesive area 330, to form a joint adhering the flaps 252, 268 to one another at the overlapping portion. As shown in FIG. 10, a small portion of the outer surface of the third side flap 276 may be in contact with the upper front side flap 252, and adhesive may be applied to this small portion, depicted generally as adhesive area 332, to form a joint adhering the flaps 252, 276 to one another at the overlapping portion. As shown in FIG. 12, adhesive may further be applied between the overlapping portion of the lower front side flap 284 and the second side flap 268, depicted as adhesive area 334, to form a joint adhering the flaps 268, 284 to one another at the overlapping portion. A small portion of the outer surface of the third side flap 276 may be in contact with the lower front side flap 284, and adhesive (not shown; see FIG. 10) may be applied to this small portion to form a joint adhering the flaps 276, 284 to one another at the overlapping portion. Although not shown in FIG. 12, adhesive is similarly applied between the corresponding overlapping portions of the flaps 250, 258, 266, 274, 282 on the other end 322 of the container 320.

In general, the adhesive areas 326-334 depicted in FIGS. 10 and 12 are the only areas where adhesive is applied. In particular, with respect to the second end 324 of the container, it should be noted that adhesive applied in the adhesive areas 328, 330, 332 does not extend to any portion of overlap between the second removable section 302 and flaps 260, 268, 274, respectively. In addition, there is no adhesive between the overlapping portion of the first side flap 260 and the second side flap 268 such that there is no joint adhering these flaps 260, 268 together. In particular, the upper front side flap 252 is adhered to the second and third side flaps 268, 276 only at the joints formed between the second longitudinally outer section 292 and the second and third side flaps 268, 276. Although not shown, adhesive is applied in a similar manner to corresponding areas on the first end 322 of the container 320.

Thus, following application of the adhesive and closure of the container 320, the first portion 340 of the container 320 is connected to the second portion 342 only at the fold/separation line 242 and respective overlap areas formed where the upper front side flaps 250, 252 overlap and are adhered to respective ones of the second side flaps 266, 268 and the third side flaps 274, 276. As shown in FIG. 12, an overlap area 346, which corresponds generally to the second longitudinally outer section 292, is formed by the overlap between the second longitudinally outer section 292 and the respective outer surfaces of the second and third side flaps 268, 276, in which the second longitudinally outer section 292 is adhered to the second and third side flaps 268, 276 in adhesive areas 330, 332, as shown in FIGS. 10 and 12. A corresponding overlap area (not shown) is formed on the second end 324 of the container 320 by the overlap between the first longitudinally outer section 290 and the respective outer surfaces of the second and third side flaps 266, 274 (see FIG. 8).

The container 320, which may be a shipping container, is generally loaded, assembled, transported, and converted for display in the orientation shown in FIG. 12. Rigidity of the shipping container 320 is maintained by the joints formed between second and third side flaps 266, 268, 274, 276; the upper front sides flaps 250, 252 and respective ones of the first, second, and third side flaps 258, 260, 266, 268, 274, 276; and the lower front side flaps 282, 284 and respective ones of the second and third side flaps 266, 268, 274, 276, as described herein. In particular, the joints between the upper front side flaps 250, 252 and the second and third side flaps 266, 268, 274, 276, and more specifically the joints formed in the overlapping areas of the longitudinally outer sections 290, 292 and the second and third side flaps 266, 268, 274, 276 (see the overlap area 346 in FIG. 12), provide enhanced rigidity without interfering with conversion of the shipping container 320 to a display container, as described below.

Figure 13:
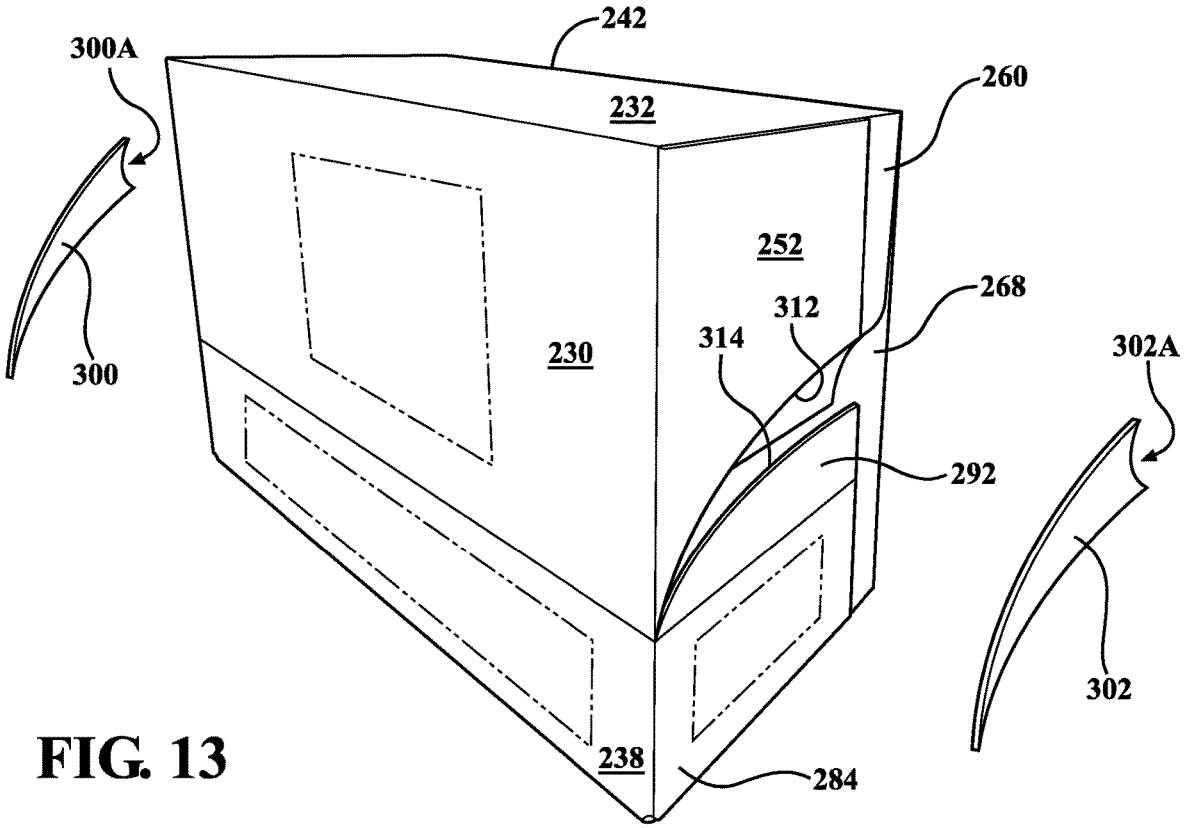
FIG. 13 is a perspective view illustrating reconfiguration of the shipping container of FIG. 12 to form a display container.
Figure 14:
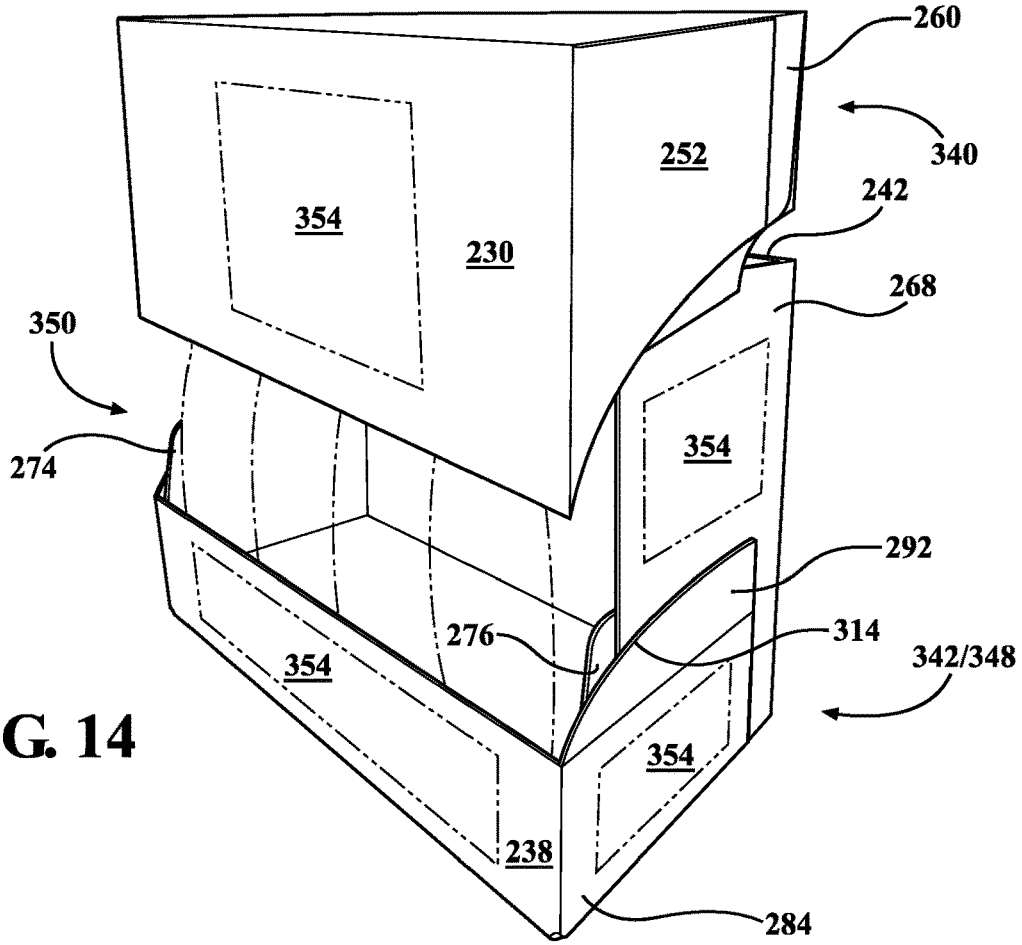
FIG. 14 is a perspective view illustrating removal of a lid portion to complete formation of the display container.
Figure 15:
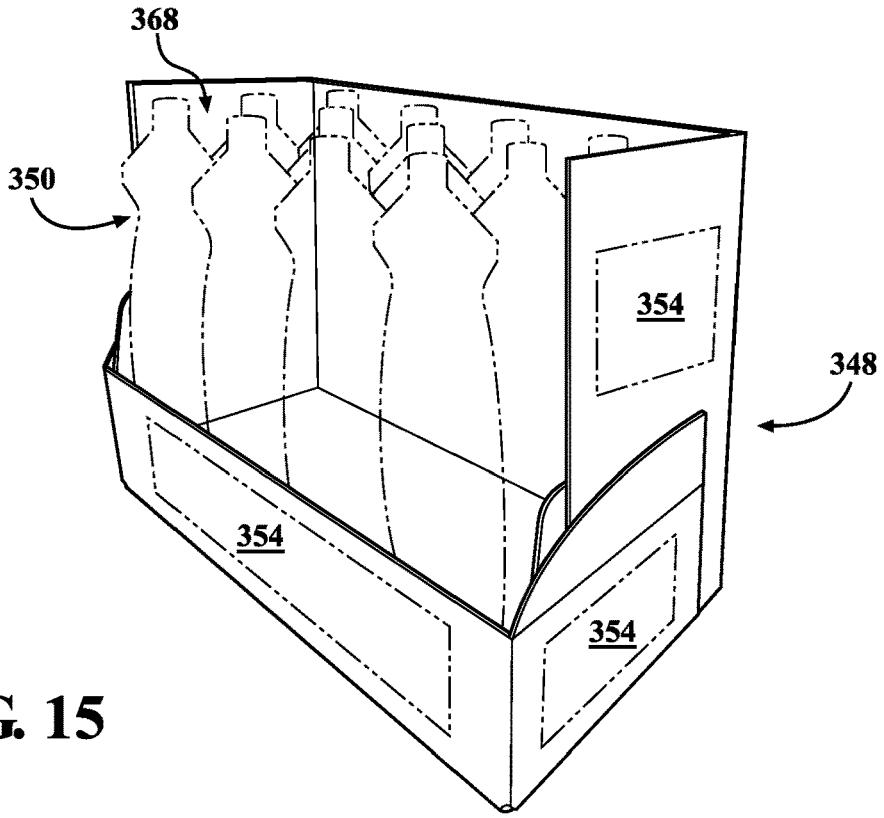
FIG. 15 is a perspective view illustrating the completed display container.

The shipping container 320 may be converted to a display case 348 for displaying the product 350 shipped therein. FIGS. 13-15 illustrate a process for reconfiguring the shipping container 320 to the display case 348. To begin the process, a user grasps the first and second removable sections 300, 302 and pulls them toward the upper and lower front panels 230, 238 to remove the first and second removable sections 300, 302 along their respective separation lines 308, 310, 312, 314, as shown in FIG. 13 (only the separation lines 312, 314 for the second removable section 302 are visible in FIG. 13; see FIG. 8). The cutouts 300A, 302A formed in the removable sections 300, 302 and the cutouts 258A, 260A formed in the first side flaps 258, 260 may assist the user with locating and grasping the first and second removable sections 300, 302. Following removal of the removable sections 300, 302, the first and second longitudinally outer sections 290, 292 detach from the lid portion 340 of the container 320, i.e., from the upper front side flaps 250, 252, and remain adhered to the base portion 342 of the shipping container 320, e.g., to the outer surfaces of respective ones of the second and third side panels 266, 268, 274, 276 (only the second longitudinally outer section 292 and second side panel 268 are visible in FIG. 13; see FIG. 8). The shipping container 320 may now be opened as a clamshell with the lid portion 340 being pivotally connected to the base portion 342 only at the second fold line 242. The lid portion 340 is otherwise unattached, e.g., without glue or other adhesive, to the base portion 342.

As shown in FIG. 14, following removal of the first and second removable sections 300, 302, the lid portion 340 of the shipping container 320 may be completely detached or separated from the base portion 342 along the separation line defined at the second fold line 242 to complete formation of the display case 348, as shown in FIG. 15, with no additional cutting or tearing required. An internal space 368 defined by the display case 348 is completely open on top, e.g., the entire second side 362 defined by the first main panel 232 (see FIG. 12) is removed. The base portion 342 thus forms the display case 348, which may be used to display the product 350 at a point of sale. The shipping container 320 may be converted to the display case 348 entirely by hand without the need for knives or other cutting tools and without damaging, removing, or otherwise disturbing the product 350 contained in the shipping container 320. With the exception of the separation lines 242, 310, 314, all exposed surfaces of the display case 348 have clean edges that are not disrupted or marred by separation from the lid portion 340, as the only connections between the lid and base portions 340, 342 are at the separation line 242 between the first and second main panels 232, 234 and the portion of the longitudinally outer sections 290, 292 that overlap and are adhered to respective ones of the second and third side flaps 266, 268, 274, 276.

As shown in FIGS. 9, 11, 14, and 15, outer surfaces of one or more of the panels and/or side flaps (e.g., the outer surface 214 of the blank 200) may comprise one or more different colors (not shown) and may include one or more regions 354 with text and/or graphics that may be located such that they remain visible and/or are revealed when the shipping container 320 is converted to the display container 348. As described herein, the longitudinal length of the lower front panel 238 may selected to be less than all other panels and/or side flaps 234, 236, 238, 266, 268, 274, 276 forming the display case 348 to improve visibility and ease of access to the product 350.

It should be understood that, although the present description references use of the container 320 at a point of sale, use of the container 320 is not limited to this particular application and may be implemented for other shipping operations.

Figure 16:
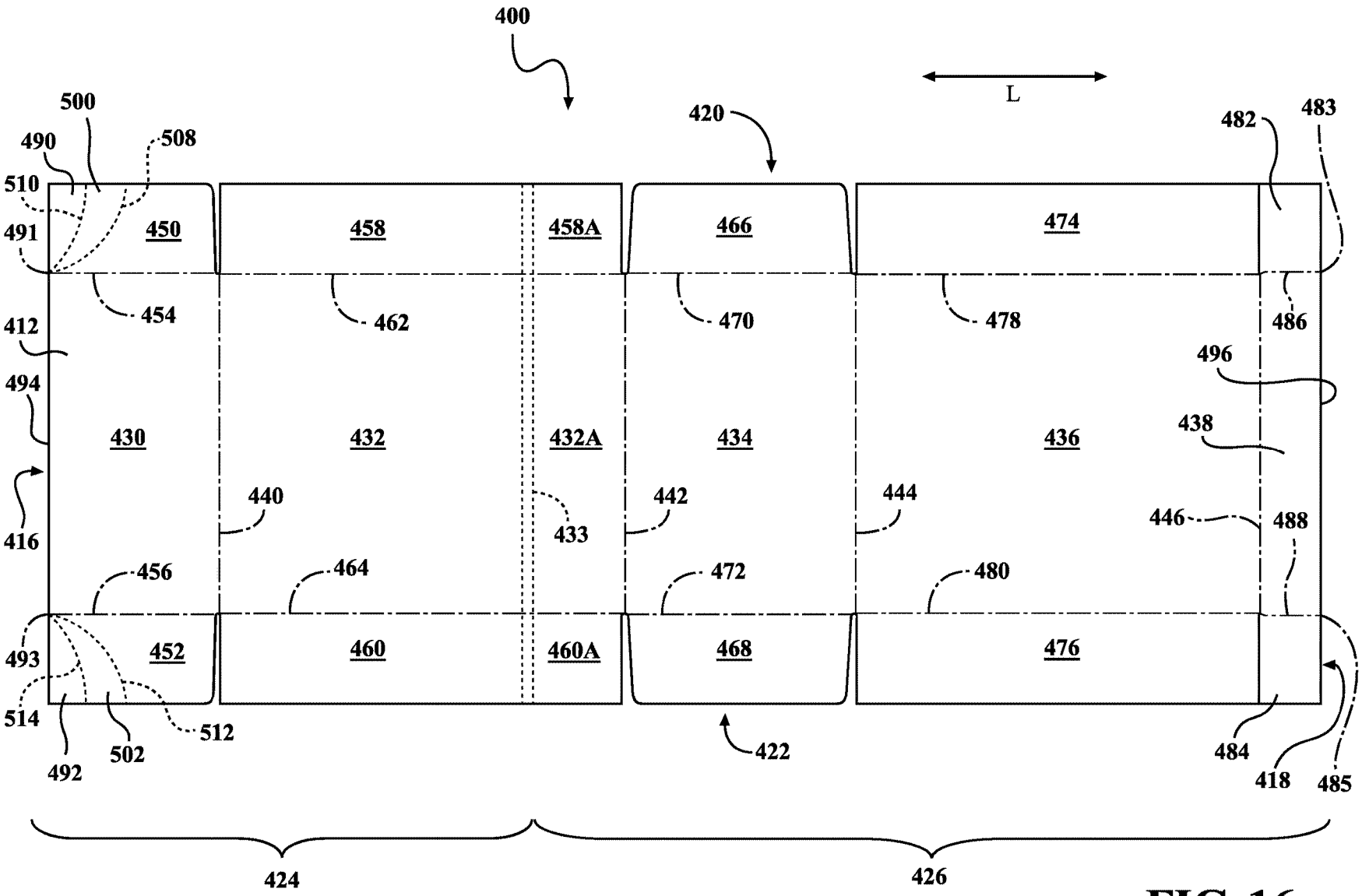
FIG. 16 is a plan view of an alternative configuration of a blank for forming a shipping container.
Figure 17:
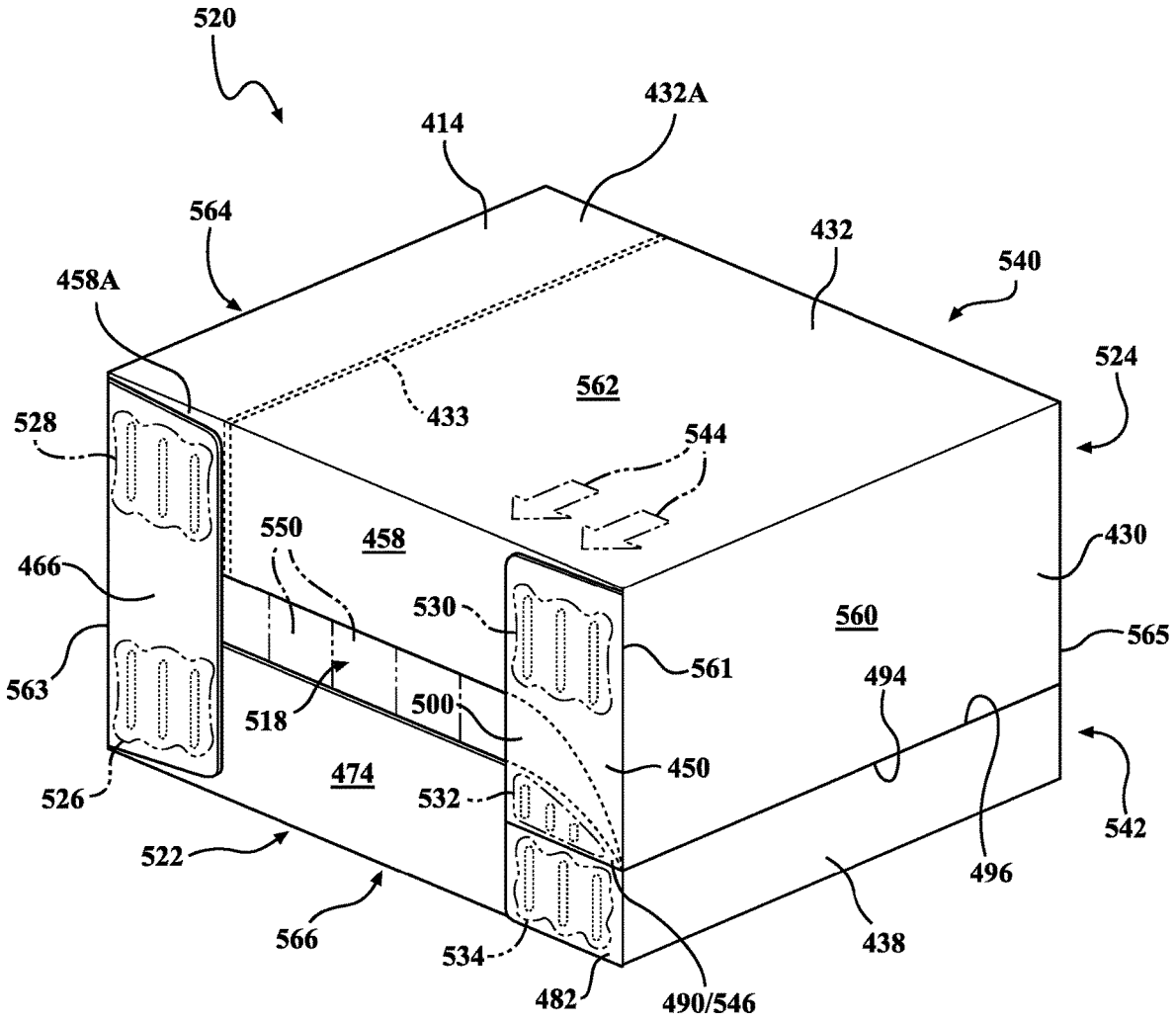
FIG. 17 is a perspective view illustrating a completed shipping container.

Referring to FIG. 16, an alternative configuration of a one-piece blank 400 is shown for illustrating one or more aspects of a shipping container 520 described herein (see FIG. 17). The blank 400 may be substantially similar to the blank 10 described above and may be formed of a corrugated cardboard material that may be die cut to the shape shown herein. The blank 400 illustrated in FIG. 16 is a planar piece of material in which an inner surface 412 is shown facing out of the page and an outer surface 414 (see FIG. 17) is facing an opposite direction from the inner surface 412. The blank 400 extends in a longitudinal direction L between first and second longitudinal ends, generally designated 416 and 418, respectively, and further extends in a lateral direction between first and second lateral edges, generally designated 420 and 422, respectively.

The blank 400 comprises a plurality of panels connected in series at respective fold lines. The blank 400 may comprise an upper front panel 430, a first main panel 432, a second main panel 434, a third main panel 436, and a lower front panel 438. The panels 430, 432, 434, 436, 438 of the blank 400 are connected in series, in which fold lines are represented by a dash-dot line and separation or tear lines are represented by a dashed line. The upper front panel 430 is connected to the first main panel 432 at a lateral fold line 440 (also referred to herein as a first fold line); the first main panel 432 is connected to the second main panel 434 at a lateral fold line 442 (also referred to herein as a second fold line); the second main panel 434 is connected to the third main panel 436 at a lateral fold line 444 (also referred to herein as a third fold line); and the lower front panel 438 is connected to the third main panel 436 at a lateral fold line 446 (also referred to herein as a fourth fold line). The first main panel 432 comprises a first main panel section 432A defined between the second fold line 442 and a separation line 433. The separation line 433 may be defined, for example, by a partial cut through at least one layer of the corrugated material or a cut line interrupted by short sections of bridging (uncut) material.

The blank 400 may include a first section 424 and a second section 426, in which the first section 424 comprises the upper front and first main panels 430, 432, and the second section 426 comprises the first main panel section 432A, the second and third main panels 434, 436, and the lower front panel 438. As will be further understood from the description below, the separation line 433 forms a structurally weakened line that may permit separation of the first main panel 432 from the first main panel section 432A, such that the first section 424 of the blank 400 is separable from the second section 426 along the separation line 433.

With continued reference to FIG. 16, a longitudinal length of the first main panel 432 (including the first main panel extension 432A), extending in the longitudinal direction L, may be substantially equal to a longitudinal length of the third main panel 436. A longitudinal length of the second main panel 434 may be substantially equal to a combined longitudinal length of the upper and lower front panels 430, 438. A longitudinal length of the lower front panel 438 may be less than a longitudinal length of the upper front panel 430. In some examples, the longitudinal length of the lower front panel 438 may be ≤50% of the longitudinal length of the upper front panel 430. In other examples, the longitudinal length of the lower front panel 438 may be less than the longitudinal length of any of the other individual panels 430, 432, 434, 436.

The upper front panel 430 comprises upper front side flaps 450, 452 that are foldably joined to laterally opposed ends of the upper front panel 430 along respective longitudinal fold lines 454, 456. The first main panel 432 comprises first side flaps 458, 460 that are foldably joined to laterally opposed ends of the first main panel 432 along respective longitudinal fold lines 462, 464. The separation line 433 extends across the first side flaps 458, 460 to form first side flap sections 458A, 460A that adjoin laterally opposed ends of the first main panel section 432A. The second main panel 434 comprises second side flaps 466, 468 that are foldably joined to laterally opposed ends of the second main panel 434 along respective longitudinal fold lines 470, 472. The third main panel 436 comprises third side flaps 474, 476 that are foldably joined to laterally opposed ends of the third main panel 436 along respective longitudinal fold lines 478, 480. The lower front panel 438 comprises lower front side flaps 482, 484 that are foldably joined to laterally opposed ends of the lower front panel 438 along respective longitudinal fold lines 486, 488.

As shown in FIG. 16, the upper front side flaps 450, 452 of the upper front panel 430 may comprise a respective one of a first longitudinally outer section 490 and a second longitudinally outer section 492. The upper front side flap 450 may further comprise a first removable section 500 that is defined between two longitudinally spaced separation lines 508, 510 that extend substantially laterally across the upper front side flap 450, in which a longitudinally outer separation line, e.g., separation line 510, defining the first removable section 500 may at least partially define the longitudinally outer section 490. The upper front side flap 452 may further comprise a corresponding second removable section 502 that is defined between two longitudinally spaced separation lines 512, 514 that extend substantially laterally across the upper front side flap 452, in which a longitudinally outer separation line, e.g., separation line 514, defining the second removable section 502 may at least partially define the second longitudinally outer section 492. The separation lines 508, 510, 512, 514 may be defined, for example, by a partial cut through at least one layer of the corrugated material or a cut line interrupted by short sections of bridging (uncut) material. The separation lines 508, 510, 512, 514 permit separation of the respective removable sections 500, 502 from the upper front end flaps 450, 452, as described further below.

At least a portion of the first removable section 500 may taper in a direction away from the first lateral edge 420 of the blank 400, and at least a portion of the second removable section 502 may taper in a direction away from the second lateral edge 422 of the blank 400. In some examples, the first and second removable sections 500, 502 may taper substantially continuously from the respective lateral edges 420, 422 of blank 400, such that the first and second removable sections 500, 502 each form an elongated pie or wedge shape. As seen in FIG. 16, the first and second removable sections 500, 502 may taper in a direction extending from a respective one of the first or second lateral edges 420, 422 toward the first longitudinal end 416 of the blank 400. One or both of the separation lines 508, 510 and 512, 514 defining the first and second removable sections 500, 502, respectively, may be curved. As shown in FIG. 16, the first removable section 500 extends between the first lateral edge 420 and the first longitudinal end 416 of the blank 400. The first removable section 500 may terminate adjacent to a junction 491 between a longitudinally outer edge of the first curved projection 490 and the first outer edge 494 of the upper front panel 430. The second removable section 502 similarly extends between the second lateral edge 422 and the first longitudinal end 416 of the blank 400. The second removable section 502 may terminate adjacent to a junction 493 between a longitudinally outer edge of the second curved projection 492 and the first outer edge 494 of the upper front panel 430.

The first longitudinal end 416 of the blank 400 may be formed by a first outer edge 494 of the upper front panel 430 and longitudinally outer edges (not separately labeled) of the longitudinally outer sections 490, 492. The second longitudinal end 418 of the blank 400 may be formed by a second outer edge 496 of the lower front panel 438 and longitudinally outer edges (not separately labeled) of the lower front side flaps 482, 484. In some examples as shown in FIG. 16, the first outer edge 494 of the upper front panel 430 may extend between the junctions 491, 493 in a substantially straight line in a lateral direction, and the longitudinally outer edges of the first and second longitudinally outer sections 490, 492 may extend in a substantially straight line in a lateral direction between a respective lateral edge 420, 422 and junction 491, 493, such that the first longitudinal end 416 of the blank 400 comprises a substantially straight outer edge. The second outer edge 496 may extend in a substantially straight line in a lateral direction between junctions 483, 485 between the second outer edge 496 and the longitudinally outer edge of respective ones of the lower front side flaps 482, 484, and the longitudinally outer edges of the lower front side flaps 482, 484 may extend in a substantially straight line in a lateral direction between a respective lateral edge 420, 422 and junction 483, 485, such that the second longitudinal end 418 of the blank 400 comprises a substantially straight outer edge.

In other examples (not shown), the first outer edge 494 and/or the longitudinally outer edges of the first and second longitudinally outer sections 490, 492 may curve outwardly in the longitudinal direction L, and the second outer edge 496 and/or the longitudinally outer edges of the lower front side flaps 482, 484 may correspondingly curve inwardly in the longitudinal direction L (see FIG. 1). As described further below, the second outer edge 496 of the lower front panel 438 abuts or is adjacent to the first outer edge 494 of the upper front panel 430 without overlap, and the respective longitudinally outer edges of the first and second longitudinally outer sections 490, 492 and the lower front side flaps 482, 484 abut or are adjacent to one another in the assembled shipping container 520 without overlap (see FIG. 12).

The blank 400 may be folded to form the container 520 of FIG. 17 using substantially the same wraparound folding operation depicted in FIGS. 2-4 with respect to the blank 10 of FIG. 1. For example, the first main panel 432 (including the first main panel section 432A) and the third main panel 436 may be folded upward from the second main panel 434 along respective fold lines 442, 444 to a generally vertical position, e.g., at approximately 90° with respect to the second main panel 434. A product 550 (see FIG. 18) to be packaged in the container 520 is placed on the second main panel 434 of the blank 400 prior to or after folding of one or both of the first and third main panels 432, 436. The first and third side flaps 458, 476 along the first lateral edge 420 of the blank 400 are folded inward toward each other along their respective fold lines 462, 470, and the first and third side flaps 460, 476 along the second lateral edge 422 are folded inward toward each other along their respective fold lines 464, 480, such that the side flaps 458, 460, 474, 476 are at approximately 90° with respect to the first main panel 432 and the third main panel 436, respectively. The second side flaps 466, 468 are folded along their respective fold lines 470, 472 at approximately 90° with respect to the second main panel 434 such that the second side flaps 466 overlap a portion of the outer surface of respective ones of the first and third side flaps 458, 460, 474, 476. The upper and lower front panels 430, 438 are folded toward each other along their respective fold lines 440, 446 at approximately 90° with respect to the first main panel 432 and the third main panel 436, respectively. The upper front side flaps 450, 452 are folded along their respective fold lines 454, 456 to overlap a portion of the respective outer surfaces of the first and third side flaps 458, 460, 474, 476. The lower front side flaps 482, 484 are folded along their respective fold lines 486, 488 to overlap a portion of the respective outer surfaces of the third side flaps 474, 476.

Figure 18:
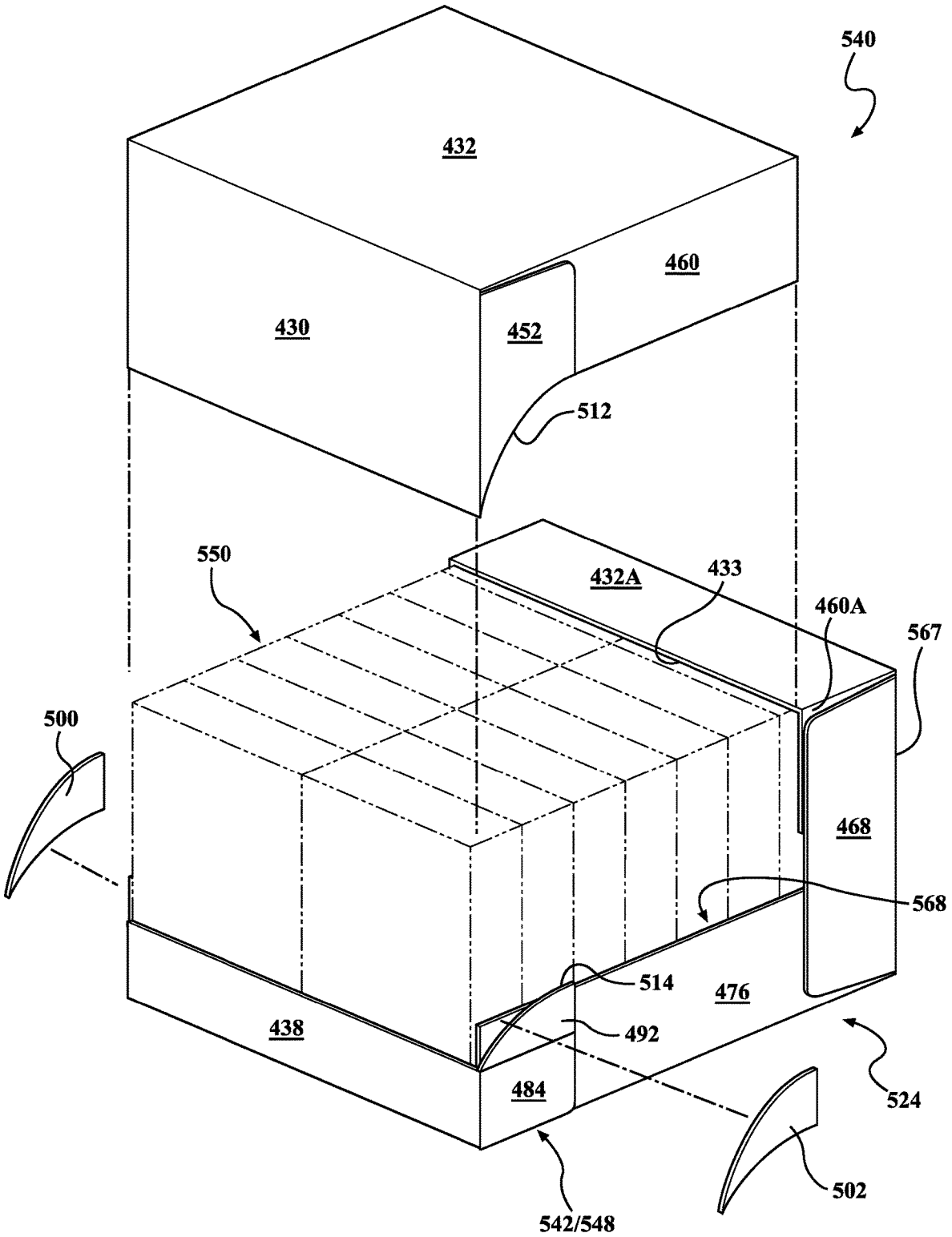
FIG. 18 is a perspective view illustrating reconfiguration of the shipping container of FIG. 17 to form a display container.

With reference to FIG. 17, a first end 522 of the container 520 is formed by the side flaps located along the first lateral edge 420 of the blank 400 (see FIG. 1), e.g., the upper front side flap 450, the first side flap 458, the second side flap 466, the third side flap 474, and the lower front side flap 482. As best seen in FIG. 18, a second end 524 of the container 520 is formed by the side flaps located along the second lateral edge 422 of the blank 400 (see FIG. 1), e.g., the upper front side flap 452, the first side flap 460, the second side flap 468, the third side flap 476, and the lower front side flap 484. In particular, the upper front side flaps 450, 452 and the lower front side flaps 482, 484 overlap at least a portion of respective ones of the first and third side flaps 458, 460, 474, 476, as described herein. The upper and lower front panels 430, 438 together may generally form a first side or face 560 of the container 520, and the first main panel 432 may generally form a second side or face 562 of the container 520, as shown in FIG. 17. The second main panel 434 may generally form a third side or face 564 (see also the corresponding third side 164 of the container 120 shown in FIG. 5A); and the third main panel 436 may generally form a fourth side or face 566 (see also the corresponding fourth side 166 of the container 120 shown in FIG. 5A).

The first end 522 of the container 520 extends between a first junction 561 of the first side 560 and the first end 522 of the container 520 and a second junction 563 of the third side 564 and the first end 522 of the container 520, as shown in FIG. 17. With reference to FIGS. 17 and 18, the second end 524 of the container 520 extends between a third junction 565 of the first side 560 and the second end 524 of the container 520 and a fourth junction 567 of the third side 564 and the second end 524 of the container 520. As shown in FIG. 17, the second side flap 466 and the upper and lower front side flaps 450, 482 extend only partially across the first end 522 of the container 520 and overlap only a portion of the first and third side flaps 458, 474. In particular, the second side flap 466 overlaps the first side flap 458 only at the first side flap section 458A and stops short of the separation line 433, as shown in FIG. 17. As best seen in FIG. 18, the second side flap 468 and upper and lower side flaps 452, 484 likewise extend only partially across the second end 524 of the container 520 and overlap only a portion of the first and third side flaps 460, 476, with the second side flap 468 overlapping the first side flap 460 only at the first side flap section 460A and stopping short of the separation line 433.

In some examples, the longitudinal length of the second main panel 434 (and the combined longitudinal lengths of the upper and lower front panels 430, 438) and a lateral width of the first and third side flaps 458, 474 may be configured such that when the container 520 is assembled, adjacent outer edges of the first and third side flaps 458, 474 are spaced apart from each other to define a gap 518, as shown in FIG. 17. A small portion of the product 550 inside the container 520 may be visible in the gap 518. Although not visible, the first and third side flaps 460, 476 on the second end 524 (see FIG. 18) may likewise be spaced apart to define a corresponding gap (not labeled). In other examples (not shown), adjacent edges of the first and third side flaps 458, 460, 474, 476 may abut one another or be spaced slightly apart (see FIGS. 5A and 5B). In all examples, there is no overlap between the first and third side flaps 458, 460, 474, 476.

In the completed container 520 shown in FIG. 17, the outer edge 494 of the upper front panel 430 is adjacent to the outer edge 496 of the lower front panel 438. The outer edges 494, 496 may abut one another or be adjacent to one another and spaced slightly apart, but there is no overlap between the upper and lower front panels 430, 438. An overlap area 546, which corresponds generally to the first longitudinally outer section 490, is formed by the overlap between the first longitudinally outer section 490 and the third side flap 474 as shown in FIG. 17, in which the first longitudinally outer section 490 is adhered to the third side flap 474, as described herein. A corresponding overlap area (not labeled) is formed on the second end 524 of the container 520 by the overlap between the second longitudinally outer section 492 and the third side flap 476, as shown in FIG. 18.

With reference to FIGS. 17 and 18, the first and second removable sections 500, 502 each extend across only a portion of a respective one of the first end 522 or the second end 524 of the container 520, i.e., the first removable section 500 extends across only a portion of the distance between the first and second junctions 561, 563 and the second removable section 502 extends across only a portion of the distance between the third and fourth junctions 565, 567. The first and second removable sections 500 and 502 also extend across only a portion of respective ones of the third side flaps 474, 476. The first removable section 500 terminates adjacent to the first junction 561 of the first side 560 and the first end 522 of the container 520, and the second removable section 502 terminates at the third junction 565 of the first side 560 and the second end 524 of the container 520. At least a portion of each of the first and second removable sections 500, 502 may taper in a direction extending from the third side 564 of the container 520 toward the first side 560 of the container 520. In some examples, the first and second removable sections 500, 502 may taper substantially continuously in the direction extending from the third side 564 toward the first side 560. The first removable section 500 spans at least a portion of a seam, i.e., the gap 518, between the first and third side flaps 458, 474 on the first end 522 of the container 520, as shown in FIG. 17. Although not visible, and the second removable section 502 likewise spans at least a portion of a seam, i.e., the gap, between the first and third side flaps 460, 476 on the second end 524 of the container 520 (see FIG. 18).

As shown in FIGS. 17 and 18, the container 520 comprises a first portion 540 (also referred to herein as a lid portion) that includes the upper front panel 430 and the first main panel 432 (excluding the first main panel section 432A), i.e., the first section 424 of the blank 400 shown in FIG. 16. The container 120 further comprises a second portion 542 (also referred to herein as a base portion) that includes the first main panel section 432A, the second main panel 434, the third main panel 436, and the lower front panel 438, i.e., the second section 426 of the blank 400.

As shown in FIG. 17 with reference to the first end 522 of the container 520, adhesive may be applied to multiple locations to close the container 520. Adhesive may be applied between the overlapping portion of the second side flap 466 and the third side flap 474, depicted generally as adhesive area 526, to form a joint adhering the flaps 466, 474 to one another at the overlapping portion. Adhesive may also be applied between the overlapping portion of the second side flap 466 and the first side flap 458, depicted generally as adhesive area 528, to form a joint adhering the flaps 458, 466 to one another at the overlapping portion. In particular, the second side flap 466 overlaps the first side flap 458 only at the first side flap section 458A, as shown in FIG. 17. Adhesive may further be applied to a portion of the overlap between the upper front side flap 450 and the first side flap 458, depicted generally as adhesive area 530, to form a joint adhering the flaps 450, 458 to one another at the overlapping portion. Adhesive may further be applied to a portion of the overlap between the upper front side flap 450 and the third side flap 474, depicted generally as adhesive area 532, to form a joint adhering the flaps 450, 474 to one another at the overlapping portion. Adhesive may further be applied between the overlapping portion of the lower front side flap 482 and the third side flap 474, depicted generally as adhesive area 534, to form a joint adhering the flaps 474, 482 to one another at the overlapping portion. Although not shown in FIG. 17, adhesive is similarly applied between the corresponding overlapping portions of the flaps 452, 460, 468, 476, 484 on the second end 524 of the container 520.

In general, the adhesive areas 526-534 depicted in FIG. 17 are the only areas where adhesive is applied on the first end 522 of the container 520. In particular, it should be noted that adhesive applied in the adhesive area 530 does not extend to any portion of the upper front side flap 450 that overlaps the third side flap 474, including the first removable section 500. Adhesive applied in the adhesive area 532 does not extend to any portion of the upper front side flap 450 that overlaps the first side flap 458. In particular, the upper front side flap 450 is adhered to the third side flap 474 only at the joint formed between the first longitudinally outer section 490 and the third side flap 474. Although not shown, adhesive is applied in a similar manner to corresponding areas on the second end 524 of the container 520. Thus, following application of the adhesive and closure of the container 520, the first portion 540 of the container 520 is connected to the second portion 542 only at the separation line 433 and the portion of the longitudinally outer sections 490, 492 that overlap and are adhered to respective ones of the third side flaps 474, 476, e.g., overlap area 546 shown in FIG. 17.

As described herein with respect to the container 120 depicted in FIGS. 5A and 5B, the completed container 520 of FIG. 17, which may be a shipping container, may be transported in a first orientation (also referred to herein as a shipping orientation) and converted to a display case 548 (see FIG. 18) and used to display the product 550 in a second orientation (also referred to herein as a display orientation). It is noted that the shipping container 520 is also generally loaded and assembled in the shipping orientation (see FIGS. 2 and 3). As shown in FIG. 17, the container 520 may include one or more arrows 544 printed on an outer surface of the first main panel 432 and/or one or more of the other panels, e.g., the third main panel 436 (not shown), that indicate an "up" position for shipping. During transport, the second main panel 434 (not visible; see FIG. 16) forms a bottom panel on which the shipping container 520 rests, and the upper and lower front panels 430, 438 together form a top panel on which additional shipping containers 520 or other containers or objects may be stacked. Rigidity of the shipping container 520 is maintained by the joints formed between the first and third side flaps 458, 460, 474, 476 and respective ones of the second side flaps 466, 468 and the upper and/or lower front side flaps 450, 452, 482, 484, as described herein. In particular, the joints between the upper front side flaps 450, 452 and the third side flaps 474, 476, and more specifically the joints formed by the overlapping areas of the longitudinally outer sections 490, 492 and the third side flaps 474, 476 (see the overlap area 546 in FIG. 17), provide enhanced rigidity without interfering with conversion of the shipping container 520 for display, as described below. The joints between the first side flap sections 458A, 460A and the second side flaps 466, 468 also help to maintain the rigidity and stacking strength of the shipping container 520.

The shipping container 520 may be converted to a display case 548 for displaying the product 550 shipped therein. To begin the process, the shipping container 520 is turned 90° from the shipping orientation to the display orientation shown in FIG. 18, in which the third main panel 436 (not visible; see FIG. 16) forms a bottom panel. A user then grasps the first and second removable sections 500, 502 and pulls them toward the upper and lower front panels 430, 438 to remove the first and second removable sections 500, 502 along their respective separation lines 508, 510, 512, 514 (only the separation lines 512, 514 for the second removable section 502 are visible in FIG. 18; see FIG. 16). As shown in FIG. 17, the gap 518 defined between the adjacent outer edges of respective ones of the first and third side flaps 458, 460, 474, 476 may allow the user to locate and grasp the first and second removable sections 500, 502. In some examples, a longitudinal length of each of the first and second removable sections 500, 502 at the respective first or second lateral edge 420, 422 (see FIG. 16) may substantially correspond to a width of the gap 518 defined by the first and third side flaps 458, 460, 474, 476 in the assembled shipping container 520.

With reference to FIG. 18, following removal of the removable sections 500, 502, the longitudinally outer sections 490, 492 detach from the lid portion 540, e.g., from remaining sections of the upper front side flaps 450, 452, and remain adhered to the base portion 542 of the shipping container 520, e.g., to the outer surfaces of respective ones of the third side panels 474, 476 (only the second longitudinally outer section 492 and third side panel 476 are visible in FIG. 18; see FIG. 17). The shipping container 520 may now be opened as a clamshell with the lid portion 540 being pivotally connected to the base portion 542 only at the separation line 433. The lid portion 540 is otherwise unattached, e.g., without glue or other adhesive, to the base portion 542. The lid portion 540 of the shipping container 520 may then be detached or separated from the base portion 542 along the separation line 433 to complete formation of the display case 548 with no additional cutting or tearing required.

An internal space 568 defined by the display case 548 is at least partially open on top, e.g., the portion of the second side 562 of the container 520 defined by the first main panel 432 (see FIG. 17) is removed. The first main panel section 432A may remain attached to the base portion 542, along with the first side flap sections 458A, 460A, which are adhered to respective ones of the second side flaps 466, 468. The base portion 542 of the shipping container 520 thus forms the display case 548, which may be used to display the product 550 at a point of sale. The shipping container 520 may be converted to the display case 548 entirely by hand without the need for knives or other cutting tools and without damaging, removing, or otherwise disturbing the product 550 contained in the shipping container 520. With the exception of the separation lines 433, 510, 514, all exposed surfaces of the display case 548 have clean edges that are not disrupted or marred by separation from the lid portion 540, as the only connections between the lid and base portions 540, 542 are at the separation line 433 between the first main panel 432 and the first main panel section 432A and the portions of the longitudinally outer sections 490, 492 that overlap and are adhered to respective ones of the third side flaps 474, 476, e.g., overlap area 546 as shown in FIG. 17. As described herein, outer surfaces of one or more of the panels and/or side flaps of the container 520 may comprise one or more different colors (not shown) and may include one or more regions (not shown) with text and/or graphics that may be located such that they remain visible and/or are revealed when the shipping container 520 is converted to the display container 548 (see FIGS. 2-4 and 7). As described herein, the longitudinal length of the lower front panel 438 may be less than all other panels and/or side flaps 434, 436, 438, 466, 468, 474, 476 forming the display case 548 to improve visibility and ease of access to the product 550.

It should be understood that, although the present description references use of the container 520 at a point of sale, use of the container 520 is not limited to this particular application and may be implemented for other shipping operations.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shipping container convertible to a display case and formed from a one-piece blank of sheet material, the shipping container comprising:

an upper front panel, a first main panel, a second main panel, a third main panel, and a lower front panel connected in series at respective first, second, third, and fourth fold lines, wherein a lid portion of the shipping container comprises the upper front panel and at least a portion of the first main panel and a base portion of the shipping container comprises the lower front panel and the second and third main panels, the lid portion being connected to the base portion along a separation line;

upper front side flaps foldably joined to the upper front panel, the upper front side flaps comprising a respective one of a first removable section and a second removable section each defined between respective pairs of separation lines and further comprising a respective one of a first curved projection and a second curved projection;

first, second, and third side flaps foldably joined to respective ones of the first, second, and third main panels; and lower front side flaps foldably joined to the lower front panel, the lower front side flaps comprise a respective one of a first recess and a second recess, the first recess corresponding to and receiving the first curved projection without overlap and the second recess corresponding to and receiving the second curved projection without overlap;

wherein the upper front and lower front side flaps overlap at least a portion of one or more of the first, second, and third side flaps to form first and second ends of the shipping container, the first removable section extending across only a portion of the first end and the second removable section extending across only a portion of the second end, and wherein the lid portion of the shipping container is completely detachable from the base portion by removing the first and second removable sections and separating the lid and base portions along the separation line.

2. The shipping container as set forth in claim 1, wherein a first outer edge of the upper front panel is adjacent to a second outer edge of the lower front panel without overlap, the upper and lower panels forming a first side of the shipping container.

3. The shipping container as set forth in claim 2, wherein:

the first, second, and third main panels form respective ones of the second, third, and fourth sides of the shipping container; and at least a portion of each of the first and second removable sections taper in a direction extending from the third side toward the first side.

4. The shipping container as set forth in claim 2, wherein:

the first removable section terminates at a junction of the first side and the first end of the shipping container; and the second removable section terminates at a junction of the first side and the second end of the shipping container.

5. The shipping container as set forth in claim 1, wherein:

the upper front panel comprises an outwardly curved outer edge; and the lower front panel comprises an inwardly curved outer edge, the inwardly curved outer edge corresponding to and receiving the outwardly curved outer edge without overlap.

6. The shipping container as set forth in claim 1, wherein the upper front side flaps comprise a respective one of a first longitudinally outer section and a second longitudinally outer section, the first longitudinally outer section being defined by a longitudinally outer one of the separation lines defining the first removable section and the second longitudinally outer section being defined by a longitudinally outer one of the separation lines defining the second removable section.

7. The shipping container as set forth in claim 6, wherein the first and second longitudinally outer sections remain adhered to the base portion following removal of the first and second removable sections.

8. The shipping container as set forth in claim 6, wherein the upper front side flaps overlap a portion of at least one of the second side flaps or the third side flaps, the upper front side flaps being adhered to the at least one of the second or third side flaps only at a joint formed between the first and second longitudinally outer sections and the at least one of the second or third side flaps.

9. The shipping container as set forth in claim 1, wherein the shipping container is loaded and transported in a first orientation and used to display a product in a second, different orientation.

10. The shipping container as set forth in claim 1, wherein the first and second removable sections each comprise a respective cutout.

11. A one-piece blank of sheet material for forming a shipping container convertible to a display case, the blank comprising:

an upper front panel and a plurality of main panels connected in series at respective fold lines; and upper front side flaps foldably joined to laterally opposed ends of the upper front panel, the upper front side flaps comprising a respective one of a first removable section and a second removable section each defined between respective pairs of separation lines;

wherein the first removable section extends between a first lateral edge and a first longitudinal end of the blank and the second removable section extends between a second lateral edge and the first longitudinal end of the blank and wherein, the upper front side flaps comprise a respective one of a first longitudinally outer section and a second longitudinally outer section;

the first longitudinally outer section is defined by a longitudinally outer one of the separation lines defining the first removable section and a first curved projection extending outward in a longitudinal direction from a first longitudinal end of the blank; and the second longitudinally outer section is defined by a longitudinally outer one of the separation lines defining the second removable section and a second curved projection extending outward in the longitudinal direction from the first longitudinal end of the blank.

12. The blank as set forth in claim 11, wherein at least a portion of the first removable section tapers in a direction away from the first lateral edge and at least a portion of the second removable section tapers in a direction away from the second lateral edge.

13. The blank as set forth in claim 11, wherein the first removable section tapers substantially continuously in a direction away from the first lateral edge and the second removable section tapers substantially continuously in a direction away from the second lateral edge.

14. The blank as set forth in claim 11, wherein the first removable section comprises a cutout extending inward from the first lateral edge and the second removable section comprises a cutout extending inward from the second lateral edge.

15. The blank as set forth in claim 11, further comprising:

a lower front panel and lower front side flaps foldably joined to laterally opposed ends of the lower front panel, wherein the lower front side flaps comprise a respective one of a first recess and a second recess extending inward in the longitudinal direction from a second longitudinal end of the blank, the first recess being configured to receive the first curved projection and the second recess being configured to receive the second curved projection.

16. The blank as set forth in claim 15, wherein:

the upper front panel comprises an outwardly curved outer edge; and the lower front panel comprises an inwardly curved outer edge, the inwardly curved outer edge corresponding to and being configured to receive the outwardly curved outer edge.

17. The blank as set forth in claim 11, further comprising a lower front panel, wherein:

the plurality of main panels comprises a first main panel, a second main panel, a third main panel, and a lower front panel connected in series at respective first, second, third, and fourth fold lines;

a first section of the blank comprises the upper front panel and at least a portion of the first main panel; and a second section of the blank comprises the lower front panel and the second and third main panels, the first section being separable from the second section along a separation line.

* * * * *